US012618617B2

(12) United States Patent
Andersson et al.

(10) Patent No.: US 12,618,617 B2
(45) Date of Patent: May 5, 2026

(54) HEAT EXCHANGER AND REFRIGERATION SYSTEM AND METHOD

(71) Applicant: SWEP International AB, Landskrona (SE)

(72) Inventors: Sven Andersson, Hässleholm (SE); Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 460 days.

(21) Appl. No.: 17/789,245

(22) PCT Filed: Jan. 29, 2021

(86) PCT No.: PCT/SE2021/050068
§ 371 (c)(1),
(2) Date: Jun. 27, 2022

(87) PCT Pub. No.: WO2021/154153
PCT Pub. Date: Aug. 5, 2021

(65) Prior Publication Data

US 2023/0041265 A1 Feb. 9, 2023

(30) Foreign Application Priority Data

Jan. 30, 2020 (SE) ..... 2050096-3

(51) Int. Cl.
*F28D 9/00* (2006.01)
*F25B 39/02* (2006.01)
(Continued)

(52) U.S. Cl.
CPC ..... *F28D 9/005* (2013.01); *F25B 39/022* (2013.01); *F28D 9/0037* (2013.01);
(Continued)

(58) Field of Classification Search
CPC ..... F28D 9/005; F28D 9/0037; F28D 9/0093; F28D 2021/0068; F25B 39/022;
(Continued)

(56) References Cited

U.S. PATENT DOCUMENTS 4,307,779 A * 12/1981 Johansson ..... F28F 13/12 165/166
4,376,460 A * 3/1983 Skoog ..... F28D 9/005 165/167
(Continued)

FOREIGN PATENT DOCUMENTS

CN 2090959 U * 12/1991
EP 1630510 A1 3/2006
(Continued)

OTHER PUBLICATIONS

English Translation of JP 2011133166A (Year: 2011).*
(Continued)

*Primary Examiner* — Tho V Duong
(74) *Attorney, Agent, or Firm* — Merchant & Gould P.C.

(57) ABSTRACT

A brazed plate heat exchanger (100) including a plurality of first and second heat exchanger plates (110, 120), wherein the first heat exchanger plates (110) are formed with a first pattern of ridges (R1) and grooves (G1), and the second heat exchanger plates (120) are formed with a second pattern of ridges (R2*a*, R2*b*) and grooves (G2*a*, G2*b*) providing contact points between at least some crossing ridges and grooves of neighbouring plates under formation of interplate flow channels for fluids to exchange heat, said interplate flow channels being in selective fluid communication port openings (O1, O2, O3, O4). The first pattern of ridges and grooves is different from the second pattern of ridges and grooves, so that an interplate flow channel volume on one side of the first heat exchanger plates (110) is different from the interplate flow channel volume on the opposite side of
(Continued)

the first heat exchanger plates (110). The heat exchanger (100) is provided with a retrofit port heat exchanger (400). A system and a method are also disclosed.

13 Claims, 16 Drawing Sheets

(51) Int. Cl.
*F28F 3/04* (2006.01)
*F28F 3/08* (2006.01)
*F28D 21/00* (2006.01)

(52) U.S. Cl.
CPC ..... *F28D 9/0093* (2013.01); *F28F 3/046* (2013.01); *F28F 3/083* (2013.01); *F25B 2313/02741* (2013.01); *F28D 2021/0068* (2013.01); *F28F 2275/04* (2013.01)

(58) Field of Classification Search
CPC . F25B 2313/02741; F28F 3/046; F28F 3/083; F28F 2275/04
See application file for complete search history.

(56) References Cited

U.S. PATENT DOCUMENTS

| | | | |
|---|---|---|---|
| 4,489,778 | A | 12/1984 | Skoog |
| 6,237,679 | B1 | 5/2001 | Vestergren |
| 6,591,896 | B1 | 7/2003 | Hansen |
| 2007/0084237 | A1 | 4/2007 | Stromblad |
| 2011/0108258 | A1 | 5/2011 | Magnier-Cathenod et al. |
| 2014/0260386 | A1 | 9/2014 | Hatanaka et al. |

FOREIGN PATENT DOCUMENTS

| | | | | | |
|---|---|---|---|---|---|
| EP | 3040670 | A1 | | 7/2016 | |
| FR | 2988822 | A1 | * | 10/2013 | ..... B21D 26/12 |
| GB | 2066938 | A | | 7/1981 | |
| GB | 2067277 | A | | 7/1981 | |
| JP | 2000105092 | A | * | 4/2000 | |
| JP | 2011133166 | A | * | 7/2011 | |
| SE | 0802382 | A1 | * | 5/2010 | |
| SE | 1050690 | A1 | * | 12/2011 | |
| WO | 2009/141379 | A1 | | 11/2009 | |
| WO | 2014/125088 | A1 | | 8/2014 | |
| WO | 2018/215426 | A1 | | 11/2018 | |
| WO | 2018215425 | A1 | | 11/2018 | |

OTHER PUBLICATIONS

PCT International Search Report for PCT Application No. PCT/SE2021/050068 mailed Mar. 23, 2021 (3 pages).
PCT Written Opinion for PCT Application No. PCT/SE2021/050068 mailed Mar. 23, 2021 (8 pages).
Swedish Search Report for SE Application No. 2050096-3 mailed Sep. 4, 2020 (3 pages).
Swedish Office Action for SE Application No. 2050096-3 mailed Sep. 4, 2020 (7 pages).

* cited by examiner

HEAT EXCHANGER AND REFRIGERATION SYSTEM AND METHOD

This application is a National Stage Application of PCT/SE2021/050068, filed 29 Jan. 2021, which claims benefit of Serial No. 2050096-3, filed 30 Jan. 2020 in Sweden, and which applications are hereby incorporated by reference in their entireties. To the extent appropriate, a claim of priority is made to each of the above disclosed applications.

FIELD OF THE INVENTION

The present invention relates to a brazed plate heat exchanger comprising a plurality of heat exchanger plates having a pattern of ridges and grooves providing contact points between at least some crossing ridges and grooves of neighboring plates under formation of interplate flow channels for fluids to exchange heat. The interplate flow channels are in selective fluid communication with four port openings for fluids to exchange heat. This type of heat exchangers also comprises a so called suction gas heat exchanger, in the form of a retrofit port heat exchanger.

The present invention is also related to a refrigeration system comprising at least one such heat exchanger. The present invention is also related to a refrigeration method using at least one such heat exchanger. Disclosed is also heat exchangers and refrigeration systems and methods.

PRIOR ART

A plurality of brazed plate heat exchangers with a pressed corrugated pattern having ridges and grooves in a herringbone pattern is known in the prior art. It is also known to provide heat exchangers with an integrated suction gas heat exchanger and to use such a heat exchanger in a refrigeration system.

In the refrigeration field, there is a constant strive towards more efficient systems. Actually, the best refrigeration systems approach the Carnot efficiency, which is the theoretical upper limit for a heat machine. Generally speaking, all refrigeration systems transforming mechanical energy to a temperature difference comprises a compressor, a condenser, an expansion valve, an evaporator, and piping enabling transport of refrigerant between the compressor, the condenser, the expansion valve and the evaporator, wherein heat is transferred from the evaporator to the condenser.

However, although the efficiency at some temperature differences may approach the Carnot efficiency, this is far from true for all running conditions.

In general terms, all heat exchangers comprised in a refrigeration system should be as large and efficient as possible. Also, they should have an as low hold-up volume as possible, and a low pressure drop. As could be understood, these criteria cannot all be met.

When it comes to the temperatures after the evaporator, every temperature increase over the temperature at which all refrigerant is evaporated (i.e. the highest boiling point of the refrigerant) will mean a loss in efficiency—however, since liquid refrigerant entering the compressor may seriously damage the compressor, it is also crucial that all refrigerant actually is vaporized before entering the compressor. A state where all the refrigerant is evaporated, although its temperature does not exceed the boiling temperature, is generally referred to as "zero superheat", and is a state being very beneficial in terms of efficiency.

One way of achieving "zero superheat" in the evaporator is to "flood" the evaporator with liquid refrigerant and let refrigerant boil off from the flooded evaporator. This configuration is common in large chiller applications, i.e. heat machines having a power of 500-1000 kW. Usually, so-called "plate and shell" or "shell and tube" heat exchangers are used for such applications.

As could be understood from the above, such evaporator configurations give great performance, but they are far from free from drawbacks. First, all heat exchangers comprising a shell are bulky and heavy, meaning that the material cost for manufacturing them are high. Secondly, and even more important, the refrigerant volume required for flooding the heat exchanger is large. Except from the cost issue, legislation often bans too large refrigerant amounts in a heat machine.

The by far most efficient heat exchanger type in terms of heat transfer/material mass is the compact brazed plate heat exchanger (BPHE). As known by persons skilled in the art, such heat exchangers comprise a number of plates made from sheet metal and provided with a pressed pattern of ridges and grooves adapted to keep the plates at a distance from one another under formation of interplate flow channels for the media to exchange heat. The plates are brazed to one another, meaning that each plate pair will be active in containing the refrigerant under pressure in the heat exchanger. Brazed plate heat exchangers have the benefit that virtually all material in the heat exchanger actually is active for heat exchange, unlike the heat exchangers comprising a shell, wherein the shell has the sole purpose of containing the refrigerant.

The evaporation processes in BPHE:s and flooded shell and tube heat exchangers are very different—as mentioned, the evaporation in a flooded shell and tube heat exchanger resembles a pool boiling, whereas in a BPHE, the refrigerant will travel more or less linearly through the interplate flow channel. The closer to the exit, the less liquid refrigerant will be present. Due to the volumetric increase due to evaporation, the velocity and hence flow resistance will increase along the length of the heat exchanger.

As mentioned above, it is crucial that no liquid refrigerant enters the compressor. Therefore, it is not uncommon that at least some of the heat exchanger contains only gaseous refrigerant. The gaseous refrigerant will take up heat and become unnecessarily hot, which will decrease the system efficiency.

It is also beneficial if the liquid refrigerant about to enter the evaporator is cool, since flash boiling phenomena can be minimized if the refrigerant is cool.

One way of securing a low refrigerant temperature of the refrigerant about to enter the expansion valve (hence reducing risk of flash boiling), while securing a high enough temperature of the gaseous refrigerant about to enter the compressor is to use a so-called suction gas heat exchanger. In its simplest form, a suction gas heat exchanger may be arranged by simply placing the piping from the evaporator to the compressor in the vicinity of the piping from the condenser to the expansion valve close to one another and braze or solder them together, such that heat may be transferred between the pipings. For larger systems, however, it is more common to provide a more efficient heat exchanger than simply two pipes placed beside one another. Normally when using a larger type of suction gas heat exchanger, the problem with evaporator outlet pressure drop and suction gas heat exchanger inlet/outlet pressure drop is destructive for the total efficiency and may cause a control problem for a system with the same.

If the superheating of the refrigerant could be kept at a minimum while it is ensured that no liquid refrigerant enters the compressor, the BPHE could be competitive with the flooded shell and tube heat exchanger also in terms of efficiency, while retaining its benefits in terms of compactness and material efficiency.

In the art of refrigeration, so-called "suction gas heat exchange" is a way to improve e.g. stability of a refrigeration system. In short, suction gas heat exchange is achieved by providing for a heat exchange between warm liquid, high pressure refrigerant from a condenser outlet and cold gaseous refrigerant from an evaporator outlet. By the suction gas heat exchange, the temperature of the cold gaseous refrigerant will increase, while the temperature of the warm liquid will decrease. This has two positive effects. Firstly, problems with flash boiling after the warm liquid has passed a subsequent expansion valve will decrease. Secondly, the risk of droplets in the gaseous refrigerant leaving the evaporator will decrease.

Suction gas heat exchanging is well known. Often, suction gas heat exchange is achieved by simply brazing or soldering pipes carrying refrigerant in the states between which heat exchange is desired to one another. This way of achieving the heat exchange is, however, costly in terms of refrigerant volume required—it is always beneficial if the piping between different components of a refrigeration system is as short as possible. Suction gas heat exchange by brazing or soldering piping carrying fluids having different temperatures together necessitates longer piping than otherwise would be the case—hence, the internal volume of the piping will increase, thereby requiring more refrigerant in the refrigeration system. This is detrimental not only from an economical point of view, but also since the amount of refrigerant to be used is limited in several jurisdictions.

Another option is to provide a separate heat exchanger for the suction gas heat exchange. Separate heat exchangers are more efficient than simply brazing different piping portions to one another. However, the provision of a separate heat exchanger also necessitates piping connecting the evaporator and the condenser to the suction gas heat exchanger, which piping will increase the refrigerant volume of the refrigeration system.

Moreover, refrigeration systems are often required to being able to operate in both heating mode and in chiller mode, depending on the required/desired load. Usually, the shift between heating and chilling mode is achieved by shifting a four-way valve such that an evaporator becomes a condenser and a condenser becomes an evaporator. Unfortunately, this means that the heat exchange in either or both the condenser/evaporator units will be a co-current heat exchange, i.e. a heat exchange wherein the media to exchange heat travels in the same general direction, in either heating or cooling mode. As is well known by persons skilled in the art, a co-current heat exchange is inferior to a counter-current heat exchange. In evaporators, a decrease of heat exchanging performance might lead to an increased risk of droplets in the refrigerant vapor that leaves the heat exchanger. Such droplets might seriously damage the compressor and are thus highly undesirable. However, devices for shifting the flow direction of the medium to exchange heat with the refrigerant in the evaporator are costly and add complexity to the refrigeration system.

It is the object of the present invention to solve or at least mitigate the above and other problems.

One object of the present invention is to provide a plate heat exchanger providing favorable fluid distribution and heat transfer between the fluids in a refrigeration system.

Another object of the present invention is to provide an efficient refrigeration system.

Yet another object of the present invention is to provide a BPHE and a refrigeration system where such a BPHE is used to achieve zero, or close to zero, superheat of refrigerant entering the compressor.

SUMMARY OF THE INVENTION

According to a first aspect of the invention, some of the above objects are achieved by a refrigeration system comprising a compressor for compressing a gaseous refrigerant such that the temperature, pressure and boiling point thereof increases, and a condenser, in which the gaseous refrigerant from the compressor exchanges heat with a high temperature heat carrier, said heat exchange resulting in the refrigerant condensing; an expansion valve reducing the pressure of liquid refrigerant from the condenser, hence reducing the boiling point of the refrigerant; an evaporator, in which the low boiling point refrigerant exchanges heat with a low temperature heat carrier, such that the refrigerant vaporizes; and a suction gas heat exchanger exchanging heat between high temperature liquid refrigerant from the condenser and low temperature gaseous refrigerant from the evaporator, characterised by a balance valve arranged to enable bypassing the high temperature liquid refrigerant such that it does not exchange heat with the low temperature gaseous refrigerant from the evaporator in the suction gas heat exchanger.

The invention also relates to a method for controlling such a system comprising the steps of a) measuring a temperature of the high temperature liquid refrigerant,
b) measuring a temperature of the low temperature gaseous refrigerant,
c) calculating a temperature difference between the high temperature liquid refrigerant and the low temperature gaseous refrigerant, and
d) controlling the balance valve to bypass the suction gas heat exchanger should the difference be less than a predetermined threshold value.

For example, the threshold value can be zero.

According to a second aspect of the invention, some of the above objects are achieved by a refrigeration system comprising a compressor for compressing a gaseous refrigerant such that the temperature, pressure and boiling point thereof increases, and a condenser, in which the gaseous refrigerant from the compressor exchanges heat with a high temperature heat carrier, said heat exchange resulting in the refrigerant condensing; an expansion valve reducing the pressure of liquid refrigerant from the condenser, hence reducing the boiling point of the refrigerant; an evaporator, in which the low boiling point refrigerant exchanges heat with a low temperature heat carrier, such that the refrigerant vaporizes; and a suction gas heat exchanger exchanging heat between high temperature liquid refrigerant from the condenser and low temperature gaseous refrigerant from the evaporator, characterised in that the low temperature gaseous refrigerant entering the suction gas heat exchanger contains a certain amount of low temperature liquid refrigerant, said low temperature liquid refrigerant vaporizing as a result of the heat exchange with the high temperature liquid refrigerant from the condenser.

According to a third aspect of the invention, some of the above objects are achieved by a plate heat exchanger comprising a plurality of heat exchanger plates provided with a pressed pattern adapted to provide contact points keeping the heat exchanger plates on a distance from one another such that interplate flow channels are formed between said plates, said heat exchanger being provided with interplate flow channels for a first medium exchanging heat with a second medium in interplate flow channels and a third medium in interplate flow channels, wherein the interplate flow channels are in selective fluid communication with port openings for the first medium, the second medium and the third medium, characterised by first and second integrated suction gas heat exchanger sections provided in the vicinity of port openings for the second medium and third medium.

According to a fourth aspect of the invention, some of the above objects are achieved by a brazed plate heat exchanger comprising a plurality of first and second heat exchanger plates, wherein the first heat exchanger plates are formed with a first pattern of ridges and grooves, and the second heat exchanger plates are formed with a second pattern of ridges and grooves providing contact points between at least some crossing ridges and grooves of neighbouring plates under formation of interplate flow channels for fluids to exchange heat, said interplate flow channels being in selective fluid communication with first, second, third and fourth large port openings and first and second small port openings, wherein the first and second heat exchanger plates are formed with a dividing surface dividing the heat exchanger plates into a first heat exchanging portion and a second heat exchanging portion, so that fluid passing between the first and second large port openings exchanges heat with fluid passing between the third and fourth port openings over the first heat exchanging portion of each plate and fluid passing between the first and second small port openings over the second heat exchanging portion of each plate, characterised in that the ridges and grooves are formed such that the interplate flow channels between different plate pairs have different volumes. Optionally, the first pattern exhibits a first angle, such as a first chevron angle, and the second pattern exhibits a second angle, such as a second chevron angle, different from the first angle.

The small port openings and the dividing surface result in an integrated suction gas heat exchanger and together with the combination of at least two different plate patterns having different interplate flow channel volumes result in a BPHE with favourable properties, such as for a refrigeration system. By the combination of different chevron angles and interplate flow channel volumes the fluid flow distribution and pressure drop can be balanced to achieve efficient heat exchange, which has been found particularly favourable for refrigeration. Such a BPHE has been found to result in practically zero, or close to zero, superheat of refrigerant entering a compressor in a refrigerant system. The evaporation is with almost zero superheat and the superheat is added outside the evaporation against a water side (secondary side). The superheat and carry over is added and the carry over droplets are evaporated during a suction gas heat exchange process resulting in a superheat not affecting the evaporation process by decreasing the heat transfer in the heat exchanger with gas towards water/brine which will occur when adding super heat in a standard heat exchanger. This results in the possibility to use co current and reach a close temperature approach.

The invention is also related to a refrigeration system comprising such a plate heat exchanger and a refrigeration method.

According to a fifth aspect of the invention, some of the above objects are achieved by a brazed plate heat exchanger comprising a plurality of first and second heat exchanger plates, wherein the first heat exchanger plates are formed with a first pattern of ridges and grooves, and the second heat exchanger plates are formed with a second pattern of ridges and grooves providing contact points between at least some crossing ridges and grooves of neighbouring plates under formation of interplate flow channels for fluids to exchange heat, said interplate flow channels being in selective fluid communication through port openings, characterised in that the first pattern of ridges and grooves is different from the second pattern of ridges and grooves, so that an interplate flow channel volume on one side of the first heat exchanger plates is different from an interplate flow channel volume on the opposite side of the first heat exchanger plates, and at least some of the ridges and grooves of the first pattern extend in a first angle and at least some of the ridges and grooves of the second pattern extend in a second angle different from the first angle.

The combination of different interplate flow channel volumes on opposite sides of the plates and at least two different plate patterns having different angles results in a BPHE with favourable properties for fluid distribution, wherein the fluid flow distribution and pressure drop can be balanced to achieve efficient heat exchange. This makes it possible to achieve different properties in interplate flow channels on opposite sides of the same plate, wherein the flow and pressure drop on one side can be different from the opposite side. Also, the different flow channel volumes on opposite sides of the plates can be used for different types of medias, such as a liquid in one and a gas in the other. Also, the combination of different interplate flow channel volumes in neighbouring interplate flow channels and at least two different plate patterns having different angles result in different brazing joint shapes, such as a width of the brazing joints in relation to media flow direction, for controlling flow of media and pressure drop.

When a refrigerant starts to evaporate, it is transferred from a liquid state to a vapour state. The liquid has a density that is much higher than the vapour density. For example refrigerant R410A at a dew point temperature Tdew=5° C. has 32 times higher density for the liquid than the vapour. This also means that the vapour will move in a channel at velocities that are 32 times higher than the liquid. This will automatically lead to the dynamic pressure drop for the vapour being 32 times higher than for the liquid, i.e. vapour creates a much higher pressure drop for all kinds of refrigerants.

The performance (Temperature Approach, TA) of a heat exchanger is defined as the water outlet temperature (at the inlet of the heat exchanger channel) minus the evaporation temperature (Tdew) at the outlet of the heat exchanger channel. A high pressure drop along the heat exchanger surface results in different local saturation temperatures that will result in a relatively large total difference in refrigerant temperature between the inlet and outlet of the channel. The temperature will be higher at the inlet of the channel. This will have a direct, detrimental impact on the performance of the heat exchanger, since a higher inlet refrigerant temperature (due to too high channel pressure drop) makes it harder to cool the outlet water to the correct temperature. The only way for the system to compensate for the too high refrigerant inlet temperature is by lowering the evaporation temperature until correct water outlet temperature can be reached. By creating a pattern for heat exchanger channels that have high heat transfer characteristics and at the same time have low pressure drop characteristics, a higher performance can be reached for the heat exchanger. A lower overall refrigerant pressure drop in the channel will not only improve the heat exchanger performance it will also have a positive impact on the total system performance and, hence, the energy consumption.

Disclosed is also the use of a brazed plate heat exchanger with different interplate flow channel volumes and different angles, with or without suction gas heat exchangers, for evaporation or condensation of media.

According to a sixth aspect of the invention, some of the above objects are achieved by a brazed plate heat exchanger comprising a plurality of first and second heat exchanger plates, wherein the first heat exchanger plates are formed with a first pattern of ridges and grooves, and the second heat exchanger plates are formed with a second pattern of ridges and grooves providing contact points between at least some crossing ridges and grooves of neighbouring plates under formation of interplate flow channels for fluids to exchange heat, said interplate flow channels being in selective fluid communication port openings, characterised in that the first pattern of ridges and grooves is different from the second pattern of ridges and grooves, so that an interplate flow channel volume on one side of the first heat exchanger plates is different from an interplate flow channel volume on the opposite side of the first heat exchanger plates. Optionally, at least a part of the first pattern exhibits a first angle and at least a part of the second pattern exhibits a second angle different from the first angle. The heat exchanger is provided with a retrofit port heat exchanger.

The invention is also related to a refrigeration system and a refrigeration method having such a heat exchanger with two different plates having different patterns and angles and provided with a retrofit port heat exchanger.

BRIEF DESCRIPTION OF THE DRAWINGS

In the following, the invention will be described with reference to appended drawings, wherein.

DESCRIPTION OF EMBODIMENTS

Figure 1:
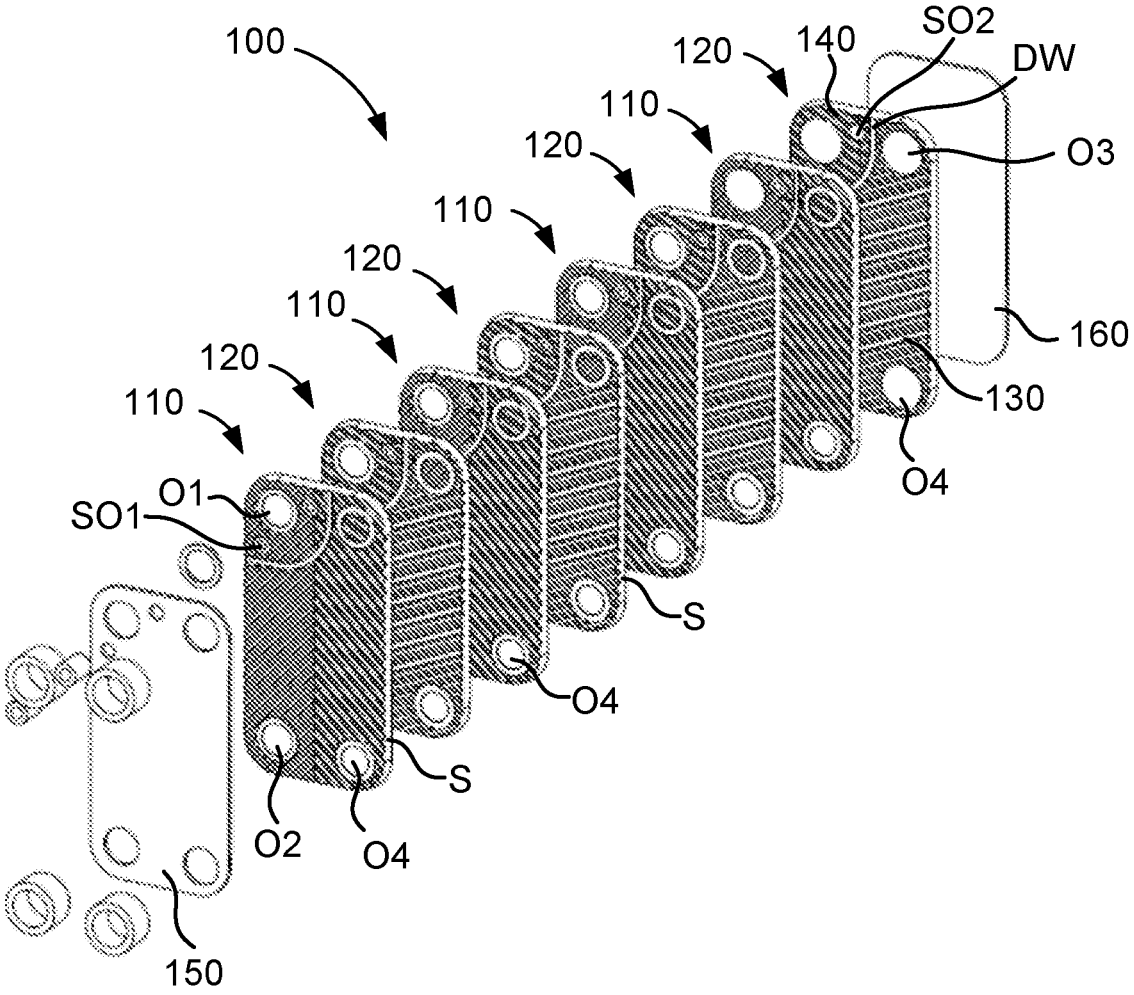
FIG. 1 is an exploded perspective view of a heat exchanger according to one embodiment of the present invention.
Figure 2:
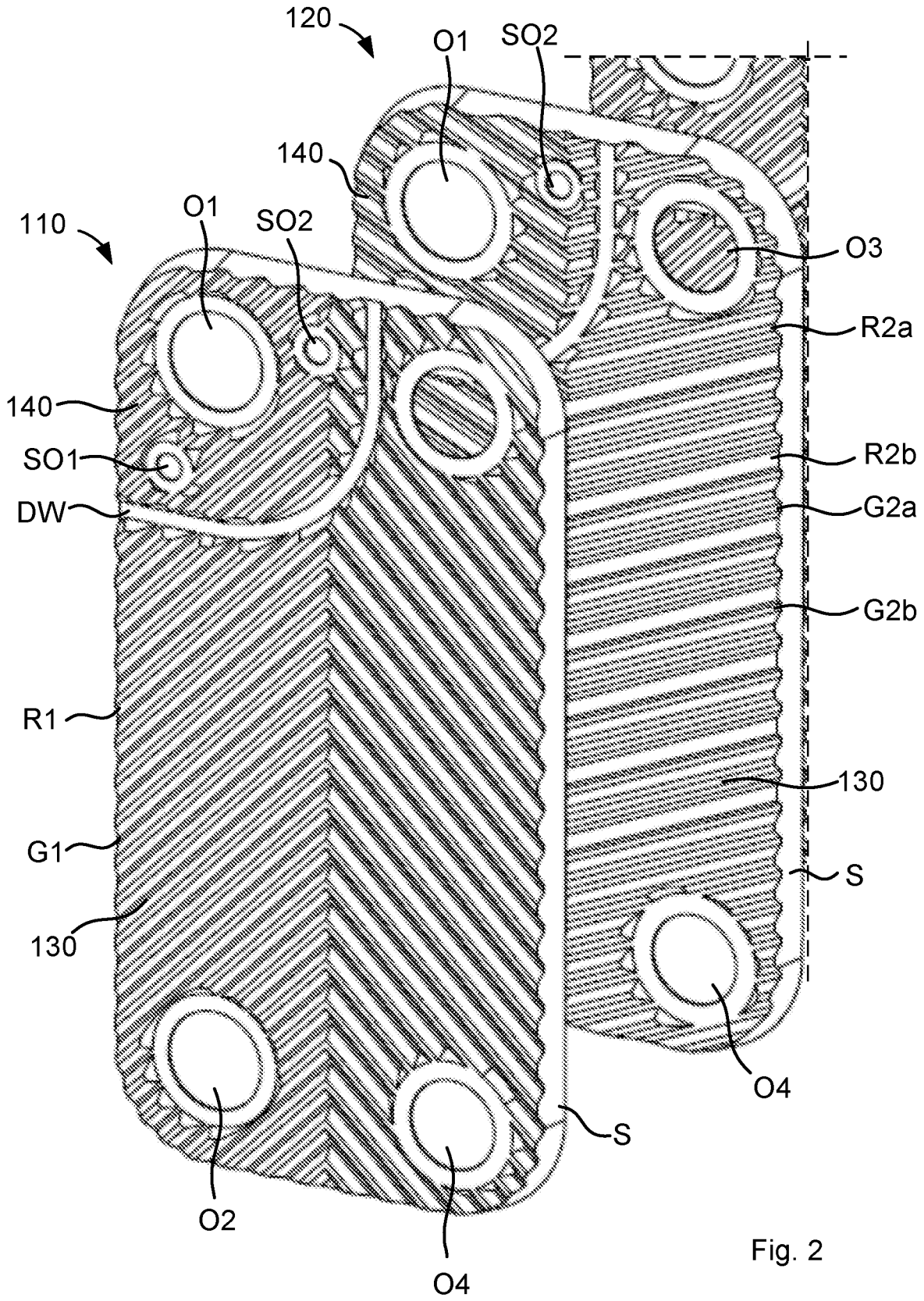
FIG. 2 is an exploded perspective view of a part of the heat exchanger of FIG. 1, illustrating a first heat exchanger plate and a second heat exchanger plate of the heat exchanger.

With reference to FIG. 1, a brazed plate heat exchanger 100 is illustrated according to one embodiment, wherein a part thereof is illustrated more in detail in FIG. 2. The heat exchanger 100 comprises a plurality of first heat exchanger plates 110 and a plurality of second heat exchanger plates 120 stacked in a stack to form the heat exchanger 100. The first and second heat exchanger plates 110, 120 are arranged alternatingly, wherein every other plate is a first heat exchanger plate 110 and every other plate is a second heat exchanger plate 120. Alternatively, the first and second heat exchanger plates are arranged in another configuration together with additional heat exchanger plates. The heat exchanger 100 is an asymmetric plate heat exchanger.

The heat exchanger plates 110, 120 are made from sheet metal and are provided with a pressed pattern of ridges R1, R2*a*, R2*b* and grooves G1, G2*a*, G2*b* (see FIG. 2) such that interplate flow channels for fluids to exchange heat are formed between the plates when the plates are stacked in a stack to form the heat exchanger 100, by providing contact points between at least some crossing ridges and grooves of neighbouring plates 110, 120 under formation of the interplate flow channels for fluids to exchange heat. The pressed pattern of FIGS. 1 and 2 is a herringbone pattern, e.g. extending along a longitudinal direction of the heat exchanger plates 110, 120. However, the pressed pattern may also be in the form of obliquely extending straight lines. In any case, the pressed pattern of ridges and grooves is a corrugated pattern. The pressed pattern is adapted to keep the plates 110, 120 at a distance from one another, except from the contact points.

Some parts of the asymmetrical heat exchanger disclosed herein will have contact points which are closer to one another than other parts. This is favourable where certain interplate flow channels are to be narrowed or constricted. By using different angles of the herringbone pattern or, alternatively, the obliquely extending lines, the brazing points can thus be elongated in the direction of fluid flow. Put differently, the dimension or width of the brazing points can be turned in the flow direction of the fluid flowing in the interplate channels of the heat exchanger. This way, one can control and thereby also balance the relationship between pressure drop and fluid flow distribution in the channels of the heat exchanger 100. As a result, the performance of the heat exchanger can be improved. In the illustrated embodiment, each of the heat exchanger plates 110, 120 is surrounded by a skirt S, which extends generally perpendicular to a plane of the heat exchanger plate, such as a plane along the longitudinal direction of the heat exchanger plate, and is adapted to contact skirts of neighbouring plates in order to provide a seal along the circumference of the heat exchanger 100.

The heat exchanger plates 110, 120 are arranged with large port openings O1-O4 and small port openings SO1, SO2 for letting fluids to exchange heat into and out of the interplate flow channels. In the illustrated embodiment, the heat exchanger plates 110, 120 are arranged with a first large port opening O1, a second large port opening O2, a third large port opening O3 and a fourth large port opening O4. Further, the heat exchanger plates 110, 120 are arranged with a first small port opening SO1 and a second small port opening SO2. Areas surrounding the large port openings O1 to O4 are provided at different heights such that selective communication between the large port openings and the interplate flow channels is achieved. In the heat exchanger 100, the areas surrounding the large port openings O1-O4 are arranged such that the first and second large port openings O1 and O2 are in fluid communication with one another through some interplate flow channels, whereas the third and fourth large port openings O3 and O4 are in fluid communication with one another by neighboring interplate flow channels. In the illustrated embodiment, the heat exchanger plates 110, 120 are rectangular with rounded corners, wherein the large port openings O1-O4 are arranged near the corners. Alternatively, the heat exchanger plates 110, 120 are square, e.g. with rounded corners. Alternatively, the heat exchanger plates 110, 120 are circular, oval or arranged with other suitable shapes, wherein the large port openings O1-O4 are distributed in a suitable manner. In the illustrated embodiment, each of the heat exchanger plates 110, 120 is formed with four large port openings O1-O4. In other embodiments of the invention, as described below, the number of large port openings may be larger than four, i.e. six, eight or ten. For example, the number of large port openings is at least six, wherein the heat exchanger is configured to provide heat exchange between at least three fluids. Hence, according to one embodiment, the heat exchanger is a three circuit heat exchanger having at least six large port openings and in addition being arranged with or without at least one integrated suction gas heat exchanger.

In the illustrated embodiment, each of the heat exchanger plates 110, 120 is formed with two small port openings SO1, SO2. The small port openings SO1, SO2 are arranged to provide an integrated suction gas heat exchanger. Hence, the first and second heat exchanger plates 110, 120 are formed with a dividing surface DW dividing the heat exchanger plates 110, 120 into a first heat exchanging portion 130 and a second heat exchanging portion 140, so that fluid passing between the first and second large port openings O1, O2 exchanges heat with fluids passing between third and fourth port openings O3, O4 over the first heat exchanging portion 130 of each plate 110, 120 and fluid passing between the first and second small port openings SO1, SO2 over the second heat exchanging portion 140 of each plate 110, 120.

The dividing surface DW is provided to divide the heat exchange area into the first heat exchanging portion 130 and the second heat exchanging portion 140. For example, the dividing surface DW is arranged between one long side of the heat exchanger plates 110, 120 and a neighbouring short side thereof. For example, the dividing surface DW extends all the way from the long side to the short side. Alternatively, the dividing surface DW is arranged between two long sides, and e.g. extends all the way from one long side to the other. In the illustrated embodiment, the dividing surface DW is curved between the long side and the short side of the plate. Alternatively, the dividing surface DW is straight or formed with a corner.

The dividing surface DW comprises an elongate flat surface provided at different heights of different plates 110, 120. When the flat surfaces of neighbouring plates 110, 120 contact one another to form the dividing surface DW, the interplate flow channel will be sealed, whereas it will be open if they do not. In the present case, the dividing surface DW is provided at the same height as the areas surrounding the first and second large port openings O1 and O2, meaning that for interplate flow channels fluidly connecting the first and second large port openings O1 and O2, the dividing surface DW will be open, whereas for interplate flow channels fluidly connecting the third and fourth large port openings O3 and O4, the dividing surface DW will block fluid in this interplate flow channel.

Since the dividing surface DW will block fluid flow in the interplate flow channel communicating with the third and fourth large port openings O3 and O4, there will be separate interplate flow channels on either side of the dividing surface DW. The interplate flow channel on the side of the dividing surface DW not communicating with the third and fourth large port openings O3 and O4 communicates with the two small port openings SO1 and SO2. It should be noted that the dividing surface DW does not block the interplate flow channels communicating with the first and second large port openings O1 and O2. Hence, medium flowing in interplate flow channels communicating with the small port openings SO1 and SO2 will exchange heat with medium flowing in flow channels communicating with the first and second large port openings O1 and O2—just like medium flowing in interplate flow channels communicating with the third and fourth large port openings O3 and O4.

In the embodiment shown in FIGS. 1 and 2, the dividing surface DW extends between the first large port opening O1 and the third large port opening O3. The small openings SO1 and SO2 are situated on either sides of the first large port opening O1. It should be noted that the first large port opening O1 is placed such that medium flowing in the interplate flow channel communicating with the small port openings SO1 and SO2 may pass on both sides of the first large port opening O1.

In the illustrated embodiment, the heat exchanger 100 comprises only the first and second heat exchanger plates 110, 120. Alternatively, the heat exchanger 100 comprises a third and optionally also a fourth heat exchanger plate, wherein the third and optional fourth heat exchanger plates are arranged with different pressed patterns than the first and second heat exchanger plates 110, 120, and wherein the heat exchanger plates are arranged in a suitable order.

In the illustrated embodiment, the heat exchanger 100 also comprises a start plate 150 and an end plate 160. The start plate 150 is formed with openings corresponding to the large port openings O1-O4 and the small port openings SO1, SO2 for letting fluids into and out of the interplate flow channels formed by the first and second heat exchanger plates 110, 120. For example, the end plate 160 is a conventional end plate.

Figure 3:
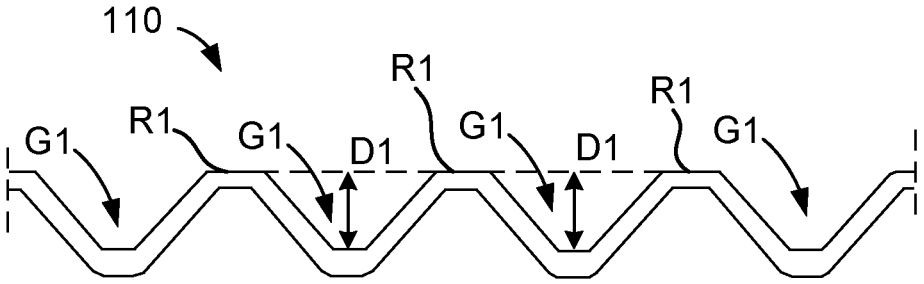
FIG. 3 is a schematic section view of another part of the first heat exchanger plate according to one embodiment, illustrating identical depth of grooves of the first heat exchanger plate.

With reference to FIG. 3, a section view of the first heat exchanger plate 110 according to one embodiment is illustrated schematically. The first heat exchanger plates 110 are formed with a first pattern of ridges R1 and grooves G1. The grooves G1 of the first heat exchanger plates are formed with identical depth D1, which is illustrated schematically in FIG. 3. Hence, all grooves G1 are formed with the same depth D1. For example, the depth D1 is 0.5-5 mm, such as 0.6-3 mm or 0.8-3 mm. For example, all ridges R1 are formed with the same height in a corresponding manner. In other words, the corrugation depth of the first heat exchanger plates 110 is symmetrical and similar throughout the plate or at least substantially throughout the plate. According to one embodiment, at least the first heat exchanging portion 130 of the first heat exchanger plate 110, such as the entire first heat exchanging portion 130 thereof, is formed with identical corrugation depth, wherein each of the grooves G1 is formed with the depth D1. For example, the first heat exchanging portion 130 and the second heat exchanging portion 140 of the first heat exchanger plate 110, such as the entire first heat exchanging portion 130 and the entire second heat exchanging portion, is formed with identical corrugation depth, wherein each of the grooves G1 is formed with the depth D1.

Figure 4:
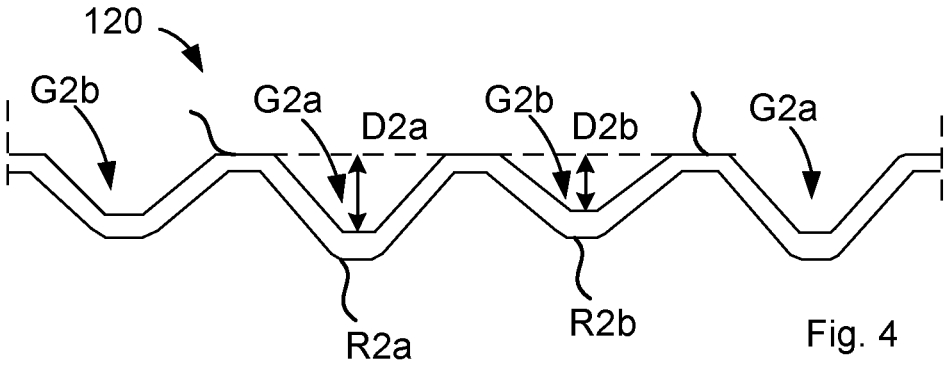
FIG. 4 is a schematic section view of a part of the second heat exchanger plate according to one embodiment, illustrating an alternating depth of grooves of the second heat exchanger plate.

With reference to FIG. 4, a section view of the second heat exchanger plate 120 is illustrated schematically according to one embodiment. For example, all second heat exchanger plates 120 are identical. The second heat exchanger plates 120 are formed with a second pattern of first and second ridges R2*a*, R2*b* and first and second grooves G2*a*, G2*b*. The first and second grooves G2*a*, G2*b* of the second heat exchanger plates 120 are formed with different depths, wherein the first grooves G2*a* are formed with a first depth D2*a*, and the second grooves G2*b* are formed with a second depth D2*b*, wherein the second depth D2*b* is different from the first depth D2*a*. For example, the first depth D2*a* is 0.5-5 mm, such as 0.6-3 mm or 0.8-3 mm, wherein the second depth D2*b* is 30-80% of the first depth D2*a*, such as 40-60% thereof. The ridges R2*a*, R2*b* have different heights in a corresponding manner. In the illustrated embodiment, the first depth D2*a* is larger than the second depth D2*b*. The first and second grooves G2*a*, G2*b* are arranged alternatingly. Alternatively, the first and second grooves G2*a*, G2*b*, and optionally further grooves having other depths, are arranged in any desired pattern.

For example, the pattern of ridges and grooves of the second heat exchanger plates 120 is asymmetrical, i.e. the second heat exchanger plates 120 form an asymmetric heat exchanger when combined with first heat exchanger plates 110 such as shown below with reference to FIG. 5. According to one embodiment, at least the first heat exchanging portion 130 of the second heat exchanger plate 120, such as the entire first heat exchanging portion 130 thereof, is formed with the second pattern of ridges and grooves having at least two different corrugation depths D2*a*, D2*b* of the grooves. For example, the first heat exchanging portion 130 and the second heat exchanging portion 140 of the first heat exchanger plate 110, such as the entire first heat exchanging portion 130 and the entire second heat exchanging portion, is formed with at least two corrugation depths, wherein the first grooves G2*a* are formed with the first depth D2*a*, and the second grooves G2*b* are formed with the second depth D2*b*.

Figure 5:
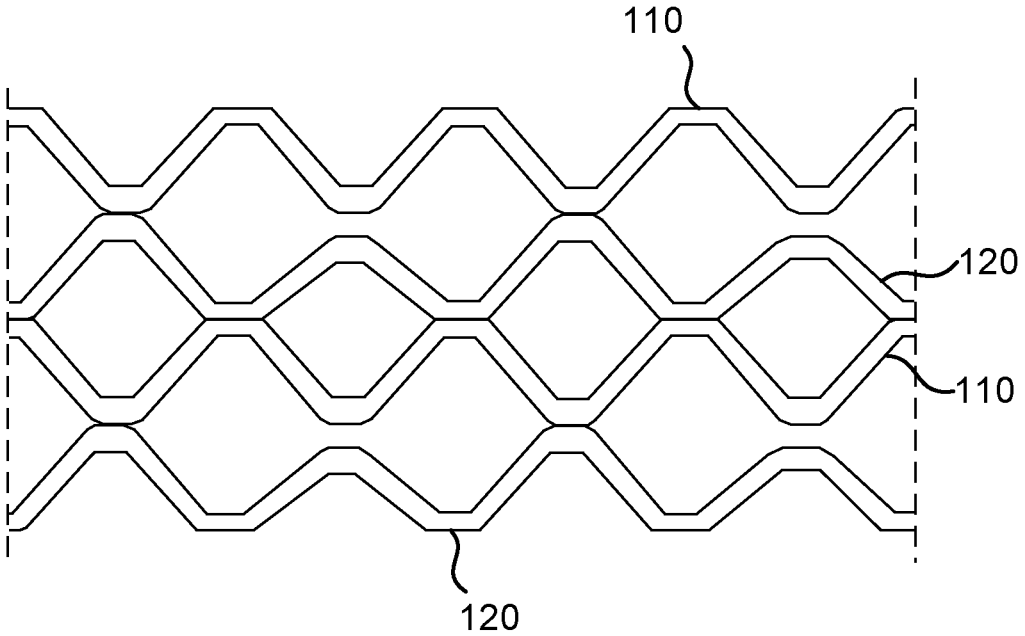
FIG. 5 is a schematic section view of a part of a heat exchanger comprising first and second heat exchanger plates according to one embodiment, wherein the first and second heat exchanger plates are alternatingly arranged.

With reference to FIG. 5, a plurality of the first and second heat exchanger plates 110, 120 have been stacked to schematically illustrate formation of interplate flow channels according to one embodiment. In the illustrated embodiment, every other plate is a first heat exchanger plate 110 and the remaining plates are second heat exchanger plates 120, wherein the first and second heat exchanger plates are arranged alternatingly to form an asymmetric heat exchanger 100, wherein the interplate flow channels are formed with different volumes. Alternatively, the different volumes of the interplate flow channels are formed by an extended profile on the same press depth or corrugation depth. For example, the first and second heat exchanger plates 110, 120 are provided with different corrugation depths. For example, the first and/or second heat exchanger plates is/are asymmetric heat exchanger plates. Alternatively, the first and/or second heat exchanger plates is/are symmetric heat exchanger plates.

Figure 6A:
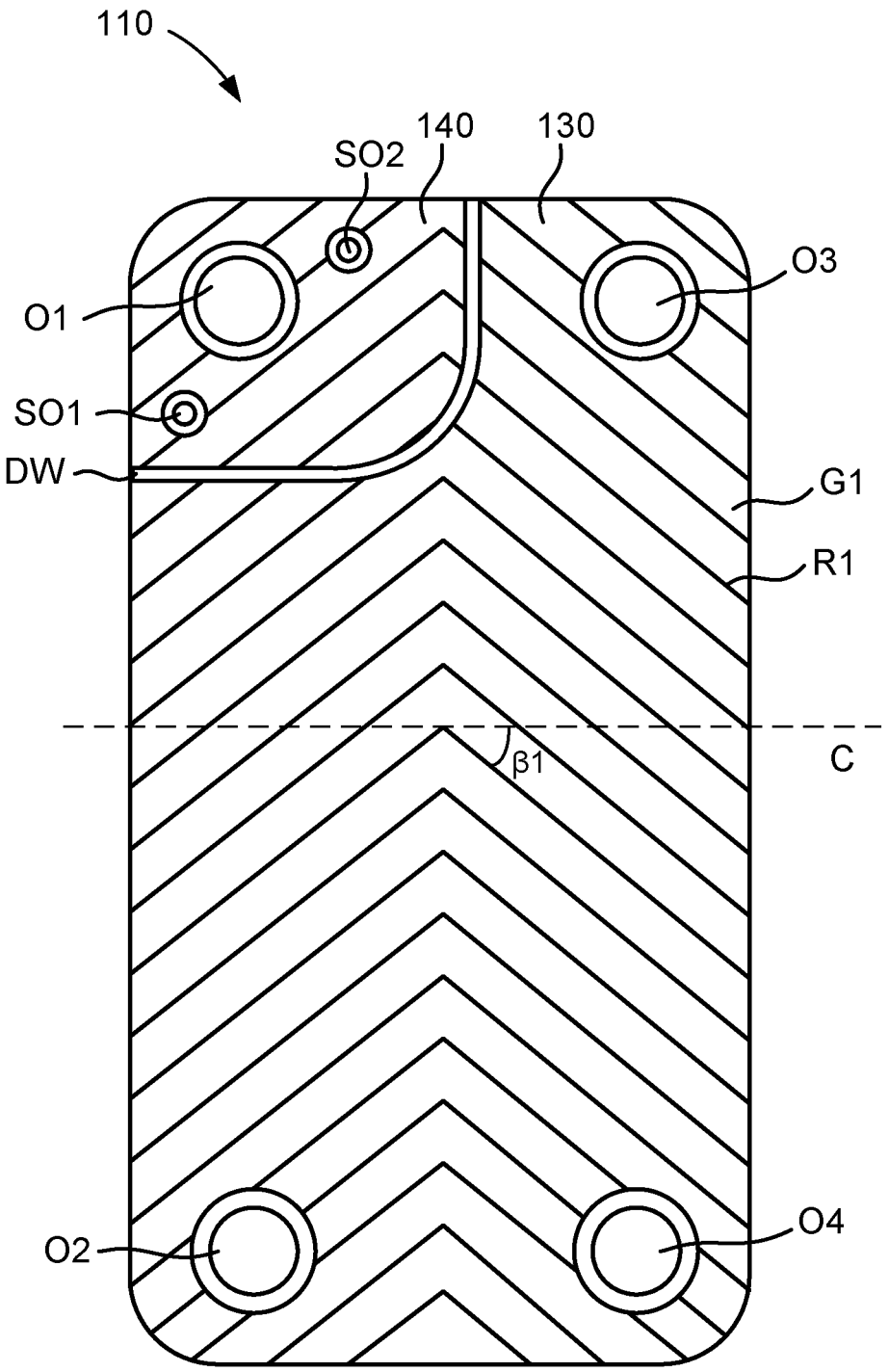
FIG. 6*a* is a schematic front view of the first heat exchanger plate according to one embodiment, illustrating a corrugated herringbone pattern thereof having a first angle in the form of a first chevron angle.

With reference to FIG. 6*a*, the first pattern of ridges R1 and grooves G1 of the first heat exchanger plate 110 is illustrated schematically. Said pattern is a pressed herringbone pattern, wherein the ridges R1 and grooves G1 are arranged with two inclined legs meeting in an apex, such as a centrally arranged apex, to form an arrow shape. For example, the apices are distributed along an imaginary centre line, such as a longitudinal centre line of a rectangular heat exchanger plate. For example, the herringbone pattern is arranged so that ridges R and grooves G, at least in a central portion of the first heat exchanger plate 110, extend from one long side to the other of the first heat exchanger plate 110, e.g. with all the apices pointing towards one of the short sides. The pattern of the first heat exchanger plate 110, i.e. the first pattern of ridges R1 and grooves G1, exhibits a first chevron angle β1. The chevron angle is the angle between the ridge and an imaginary line across the plate, perpendicular to the long sides of a rectangular plate, which is illustrated schematically by means of the dashed line C. Hence, the chevron angle is the angle between the ridge and a short side of the heat exchanger plate towards which the apex is pointing. The long sides of the heat exchanger plates extend perpendicular to the short sides and hence the pattern of ridges and grooves is also arranged so that the ridges have an angle to the long sides. For example, the chevron angle is the same on both sides of the apex. For example, the entire or substantially entire first pattern of ridges and grooves is formed with the first chevron angle β1 throughout the plate or at least throughput the first heat exchanging portion 130, and for example also the second heat exchanging portion 140. For example, the first chevron angle β1 is 5° to 85°, 25° to 70° or 30° to 45°.

Figure 6B:
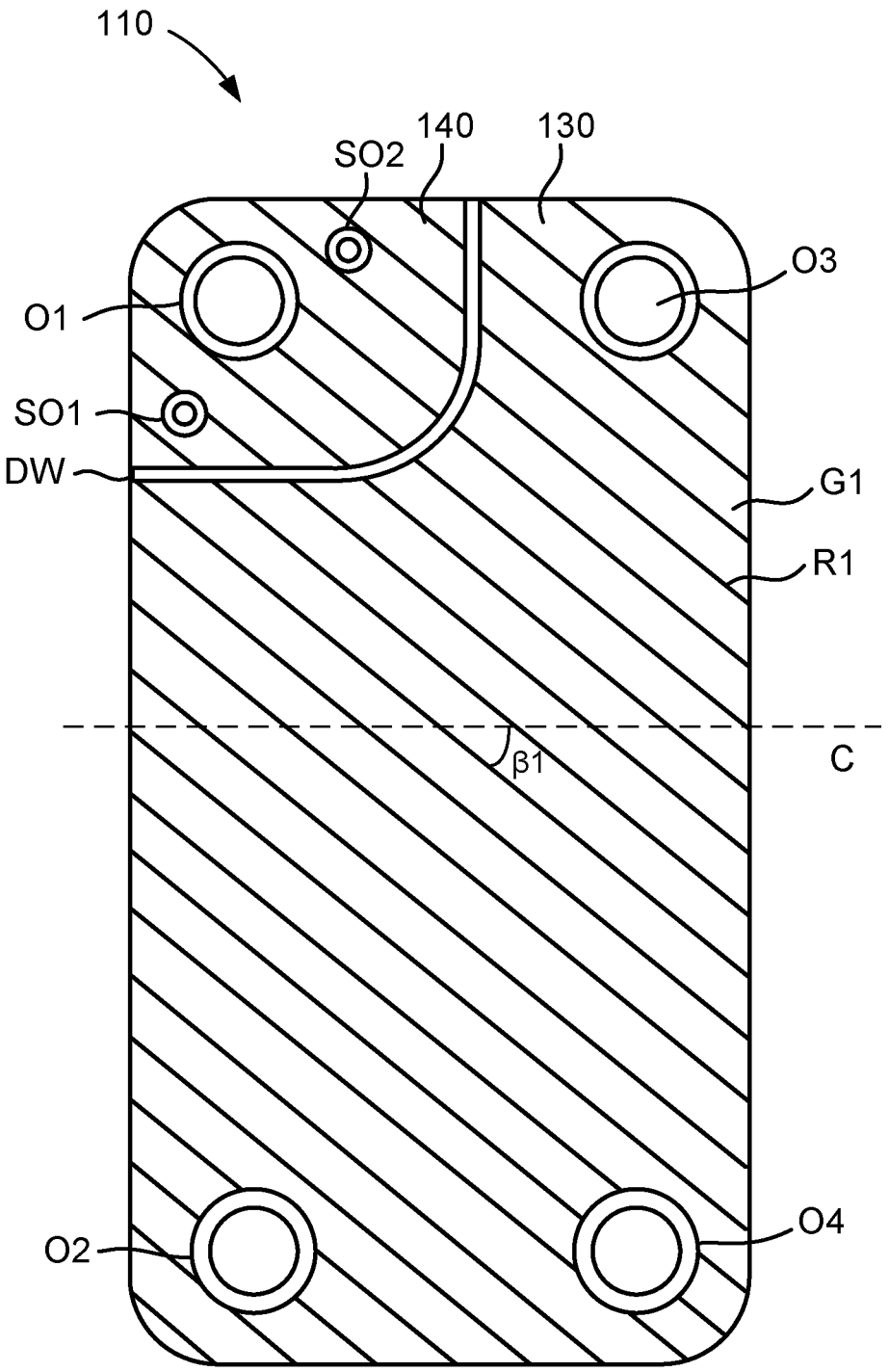
FIG. 6*b* is a schematic front view of the first heat exchanger plate according to an alternative embodiment, illustrating a corrugated pattern thereof having a first angle.

With reference to FIG. 6*b*, the first pattern of ridges R1 and grooves G1 of the first heat exchanger plate 110 is illustrated schematically according to an alternative embodiment, wherein the pressed pattern is in the form of obliquely extending straight lines. Hence, the pressed pattern of ridges and grooves is a corrugated pattern of obliquely extending straight lines. The obliquely extending straight lines of the first heat exchanger plates 110 are arranged in the angle β1 with respect to the dashed line C across the plate. For example, the pattern is arranged so that ridges R1 and grooves G1 extend, e.g. in parallel, from one long side to the other of the first heat exchanger plate 110

Figure 7A:
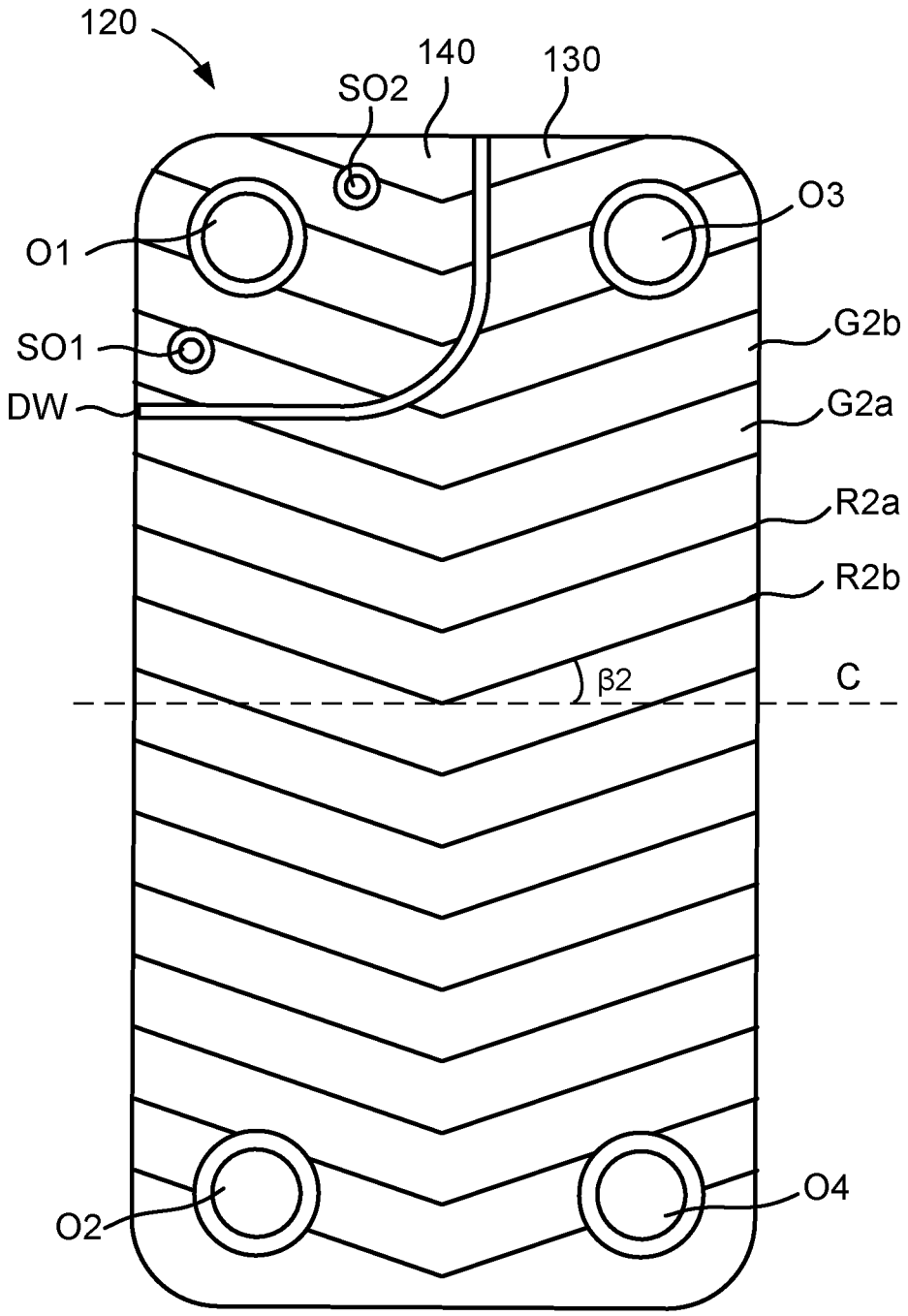
FIG. 7*a* is a schematic front view of the second heat exchanger plate according to one embodiment, illustrating a corrugated herringbone pattern thereof having a second angle in the form of a second chevron angle.

With reference to FIG. 7*a*, the second pattern of ridges R2*a*, R2*b* and grooves G2*a*, G2*b* of the second heat exchanger plate 120 is illustrated schematically. Said second pattern is a pressed herringbone pattern as described above with reference to the first heat exchanger plate 110 but with a second chevron angle β2 different from the first chevron angle β1. Hence, the second heat exchanger plate 120 is arranged with a herringbone pattern having a different angle than that of the first heat exchanger plate 110. For example, the second chevron angle β2 is 5° to 85°, 25° to 70° or 30° to 45°. For example, the entire or substantially entire pattern of ridges and grooves of the second heat exchanger plates 120 is formed with the second chevron angle β2 throughout the plate or at least throughput the first heat exchanging portion 130, and for example also the second heat exchanging portion 140. For example, a difference between the first and second chevron angles β1 and β2 is 2° to 35°.

Figure 7B:
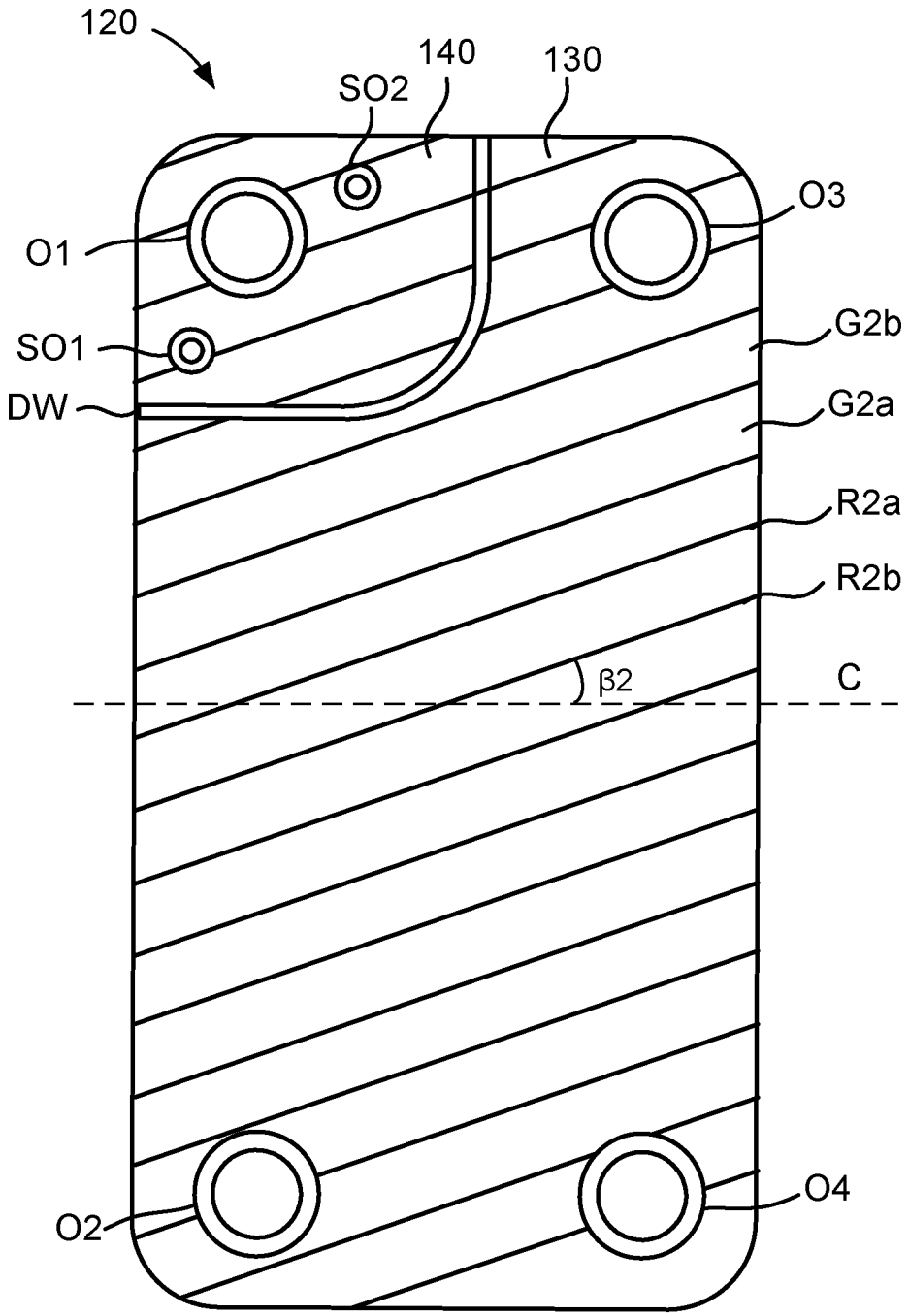
FIG. 7*b* is a schematic front view of the second heat exchanger plate according to an alternative embodiment, illustrating a corrugated pattern thereof having a second angle.

With reference to FIG. 7*b*, the second pattern of ridges R2*a*, R2*b* and grooves G2*a*, G2*b* of the second heat exchanger plate 120 is illustrated schematically according to an alternative embodiment, wherein the pressed pattern is in the form of obliquely extending straight lines. Hence, the pressed pattern of ridges and grooves is a corrugated pattern of obliquely extending straight lines. The obliquely extending straight lines of the second heat exchanger plates 120 are arranged in the angle β2 with respect to the dashed line C across the plate. For example, the pattern is arranged so that ridges R2*a*, R2*b* and grooves G2*a*, G2*b* extend, e.g. in parallel, from one long side to the other of the second heat exchanger plate 120.

Hence, the first and second heat exchanger plates 110, 120 are formed with different chevron angles β1, β2 and different pressed patterns resulting in different interplate volumes. For example, the first and second heat exchanger plates 110, 120 are provided with different corrugation depths. Alternatively or in addition, the first and second heat exchanger plates 110, 120 are provided with different corrugation frequencies. The corrugation frequency is the number of ridges and grooves along a defined distance, which e.g. correlates to a distance between neighbouring ridges and grooves. Hence, a plate having a higher corrugation frequency displays a greater number of ridges and grooves with respect to a plate of the same shape and size having a comparatively lower corrugation frequency. For example, the first and second heat exchanger plates 110, 120 are provided with the same corrugation depth but different corrugation frequencies. Hence, the first and second heat exchanger plates 110, 120 are provided with different corrugation depths and/or different corrugation frequencies. For example, one of the first and second heat exchanger plates 110, 120 is a symmetric heat exchanger plate, wherein the other is asymmetric. Alternatively, both the first and second heat exchanger plates 110, 120 are asymmetric. Alternatively, both the first and second heat exchanger plates 110, 120 are symmetric.

Figure 8:
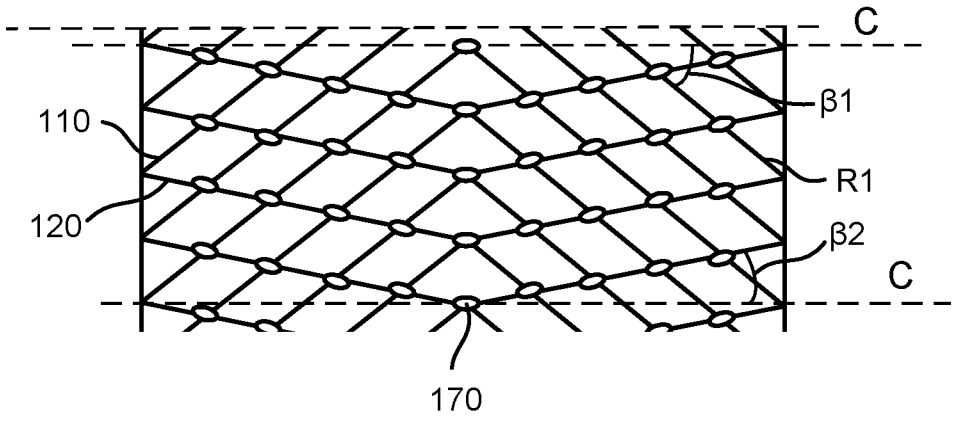
FIG. 8 is a schematic view of the first heat exchanger plate arranged on the second heat exchanger plate, illustrating contact points between them according to the example of FIG. 5.
Figure 9:
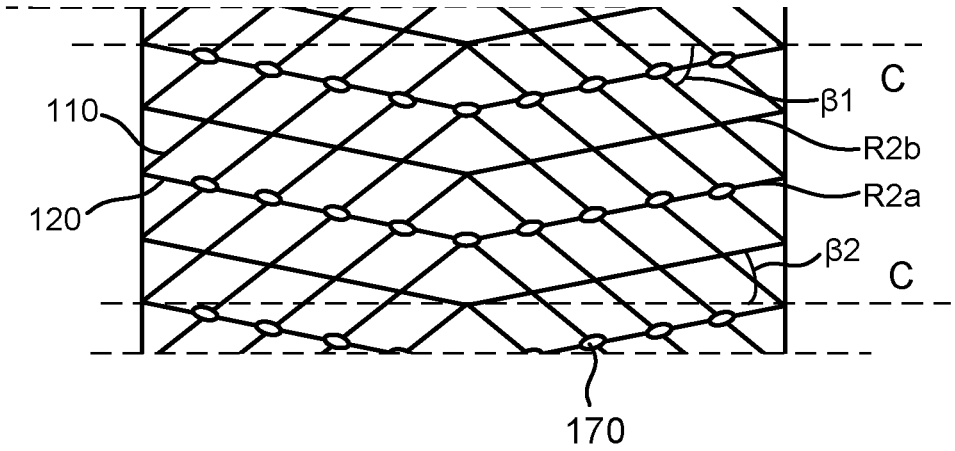
FIG. 9 is a schematic view of the second heat exchanger plate arranged on the first heat exchanger plate, illustrating contact points between them according to the example of FIG. 5.

In FIGS. 8 and 9 contact points between the first and second plates 110, 120 are illustrated schematically using the example of FIG. 5. In and/or around the contact points 170 between crossing ridges and grooves brazing joints 170 are formed. In the embodiment of FIGS. 8 and 9 brazing joints 170 are formed in all contact points. Alternatively, brazing joints 170 are formed in only some of the contact points. In FIG. 8, the first heat exchanger plate 110 is arranged on the second heat exchanger plate 120, wherein contact points are formed in a first pattern. In FIG. 8 all crossings between the ridges R1 of the first heat exchanger plate 110 and ridges R2*a*, R2*b* or grooves G2*a*, G2*b* of the second heat exchanger plate 120 result in a contact point.

FIG. 9 is a schematic view of the second heat exchanger plate 120 arranged on the first heat exchanger plate 110, wherein contact points are formed in a second pattern. In FIG. 9 only crossings between the first ridges R2*a* of the second heat exchanger plate 120 result in a contact point, which may form a brazing joint 170, wherein the second ridges R2*b* are arranged with a gap to the crossing ridges or grooves of the first heat exchanger plate 110. Hence, no contact points are formed and no brazing joint is formed between the second ridges R2*b* of the second heat exchanger plate 120 and the first heat exchanger plate 110. In FIG. 9, all contact points are shown with a brazing joint 170.

According to one embodiment, the brazing joints 170 between the first and second heat exchanger plates 110, 120 are elongated, such as oval, wherein the brazing joints 170 are arranged in a first orientation in the interplate flow channels having bigger volume and in a second orientation in the interplate flow channels having smaller volume to provide a favourable pressure drop in the desired interplate flow channels. For example, the brazing joints 170 are arranged in a first angle in relation to a longitudinal direction of the plates 110, 120 in the interplate flow channels having bigger volume and in a second angle in the remaining interplate flow channels. According to one embodiment, the first angle is bigger than the second angle.

In FIGS. 10*a*, 10*b* and 11*a*, 11*b*, embodiments of a chiller system that can use a heat exchanger 100 according to any of the above heat exchanger embodiments is shown in heating mode and cooling mode, respectively. Chiller system can also be called refrigeration system. The chiller system is applicable to a heat exchanger with retrofit suction gas heat exchangers as described below with reference to FIGS. 12-14 instead of the integrated suction gas heat exchangers as illustrated in the chiller system.

The chiller system according to the embodiments of FIGS. 10*a*, 10*b*, 11*a*, 11*b* comprises a compressor C, a four-way valve FWV, a payload heat exchanger PLHE connected to a brine system requiring heating or cooling, a first controllable expansion valve EXPV1, a first one-way valve OWV1, a dump heat exchanger DHE connected to a heat source to which undesired heat or cold could be dumped, a second expansion valve EXPV2 and a second one-way valve OWV2. The heat exchangers PLHE and DHE are each provided with the four large openings O1-O4 as disclosed above and the two small openings SO1 and SO2, wherein the large openings O1 and O2 of each heat exchanger communicate with one another, the large openings O3 and O4 of each heat exchanger communicate with one another and wherein the small openings SO1 and SO2 of each heat exchanger communicate with one another. Heat exchange will occur between fluids flowing from O1 to O2 and fluids flowing between O3 and O4 and SO1 and SO2. There will, however, be no heat exchange between fluids flowing from O3 to O4 and fluids flowing from SO1 to SO2. The payload heat exchanger PLHE and/or the dump heat exchanger DHE is/are a plate heat exchanger 100 as described herein.

Figure 10A:
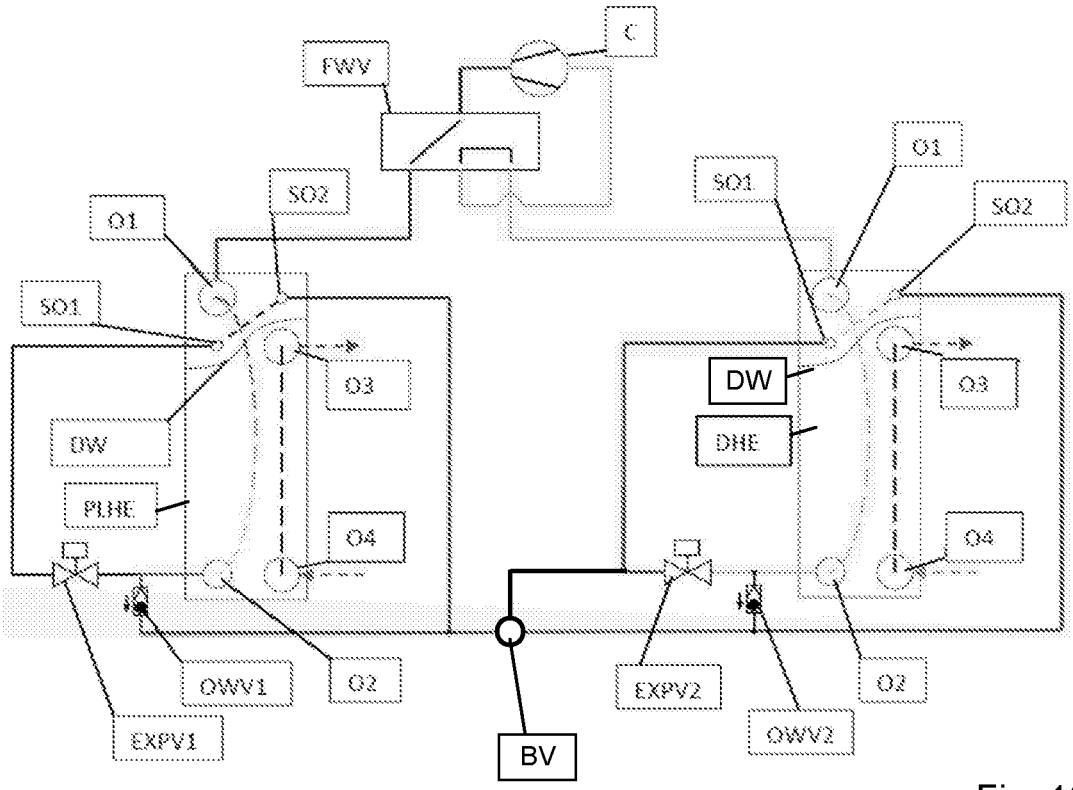
FIG. 10*a* is a schematic plan view showing a refrigeration system according to a first embodiment of the present invention in heating mode.
Figure 10B:
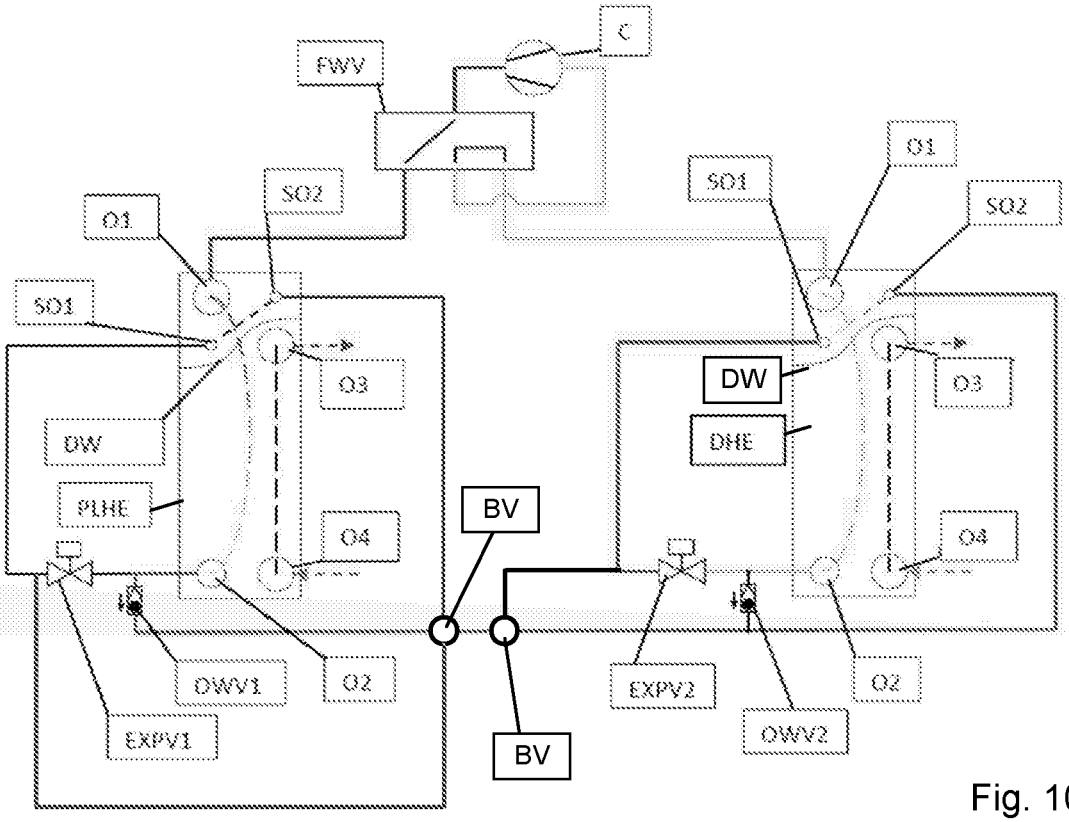
FIG. 10*b* is a schematic plan view showing a refrigeration system according to a second embodiment of the present invention in heating mode.

In heating mode, shown in FIGS. 10*a* and 10*b*, the compressor C will deliver high pressure gaseous refrigerant to the four-way valve FWV. In this heating mode, the four-way valve is controlled to convey the high pressure gaseous refrigerant to the large opening O1 of the payload heat exchanger PLHE. The high pressure, gaseous refrigerant will then pass the payload heat exchanger PLHE and exit at the large opening O2. While passing the payload heat exchanger PLHE, the high pressure gaseous refrigerant will exchange heat with a brine solution connected to a payload requiring heating and flowing from the large opening O4 to the large opening O3, i.e. in a counterflow direction compared to the refrigerant, which flows from the first large opening O1 to the second large opening O2. While exchanging heat with the brine solution, the high pressure gaseous refrigerant will condense, and when exiting the payload heat exchanger PLHE through the large opening O2, it will be fully condensed, i.e. be in the liquid state.

In the heating mode, the first expansion valve EXPV1 will be fully closed, and the flow of liquid refrigerant exiting the payload heat exchanger will pass the first one-way valve OWV1, which allows for a refrigerant flow in this direction, while it will block flow in the other direction (which will be explained later in connection to the description of the cooling mode).

After having passed the first one-way valve OWV1, the liquid refrigerant (still comparatively hot) will enter the small opening SO2 of the dump heat exchanger DHE and exit the dump heat exchanger through the small opening SO1. During the passage between the small openings SO2 and SO1, the temperature of the refrigerant will drop significantly due to heat exchange with cold, primarily gaseous refrigerant about to exit the dump heat exchanger DHE.

During e.g. a cold start, i.e. before the system has reached a favourable running condition, it might be necessary to balance the amount of heat exchange in the suction gas heat exchanger. This can be achieved by controlling a balance valve BV, the balance valve BV being e.g. a three-way valve arranged to enable control of liquid refrigerant from the condenser to either, or both, of the small opening SO2 and the expansion valve EXPV2, hence controlling the amount of heat exchange in the suction gas heat exchanger.

After leaving the dump heat exchanger DHE through the small opening SO1, the liquid refrigerant will pass the second expansion valve EXPV2, where the pressure of the refrigerant will drop, causing flash boiling of some of the refrigerant, which will cause the temperature to drop. From the second expansion valve EXPV2, the refrigerant will pass a branch connected to both the second one-way valve OWV2, which is connected between the high pressure side and the low pressure side of the refrigerant circuitry and closed for refrigerant flow due to the pressure difference between the high pressure side and the low pressure side. After having passed the branch, the cold, low pressure semi liquid refrigerant will enter the large opening O2 and pass the dump heat exchanger DHE under heat exchange with a brine solution connected to a source from which low temperature heat can be collected, e.g. an outside air collector, a solar collector or a hole drilled in the ground. Due to the heat exchange with the brine solution, which flows from the large opening O4 to the large opening O3, the primarily liquid refrigerant will vaporize. The heat exchange between the brine solution and the refrigerant will take place under co-current conditions, which is well known to give an inferior heat exchange performance as compared to counter-current heat exchange.

Just prior to the exiting the dump heat exchanger DHE through the large opening O1, the refrigerant (now almost completely vaporized) will exchange heat with the comparatively hot, liquid refrigerant that entered the dump heat exchanger through the small opening SO2 and exited the dump heat exchanger through the small port opening SO1. According to one embodiment of the invention, about 85-98, preferably 90-95 and more preferably 91-94, e.g. 93 percent of the refrigerant is vaporized when it starts exchange heat with the hot liquid refrigerant.

Consequently, the temperature of the refrigerant about to exit the dump heat exchanger DHE through the large opening O1 will increase, hence ensuring that all of this refrigerant is completely vaporized.

Hence, the low temperature gaseous refrigerant entering the suction gas heat exchanger contains a certain amount of low temperature liquid refrigerant, said low temperature liquid refrigerant vaporizing as a result of the heat exchange with the high temperature liquid refrigerant from the condenser. For example, said certain amount of low temperature liquid refrigerant amounts to 2-15, preferably 5-10, more preferably 6-9 and for example 7 percent by mass.

It is well known by persons skilled in the art that co-current heat exchange is inferior to counter-current heat exchange when it comes to the heat exchange performance. However, due to the provision of the heat exchange between the relatively hot liquid refrigerant entering the small opening SO2 and the mainly gaseous refrigerant about to leave the dump heat exchanger DHE (i.e. a so-called "suction gas heat exchange"), it is not necessary to vaporize the refrigerant completely during the brine-refrigerant heat exchange. Instead, the refrigerant may be only semi-vaporized when it enters the suction gas heat exchanger with the hot liquid refrigerant, since the remaining liquid phase refrigerant will evaporate during this heat exchange. It is well known that liquid-to-liquid heat exchange is much more efficient than gas-to-liquid heat exchange. Also, co-current heat exchange has the additional benefit that the risk of freezing is reduced, since the refrigerant enters the heat exchanger in a position where the medium with which the refrigerant shall exchange heat has a high temperature, hence reducing the risk of freezing at this position, which is the most critical position for freezing.

Tests have shown that there might be a problem with cold-starting the chiller system in cold environments.

From the large opening O1 of the dump heat exchanger, the gaseous refrigerant will enter the four-way valve FWV, which is controlled to direct the flow of gaseous refrigerant to the compressor, in which the refrigerant is compressed again.

Figure 11A:
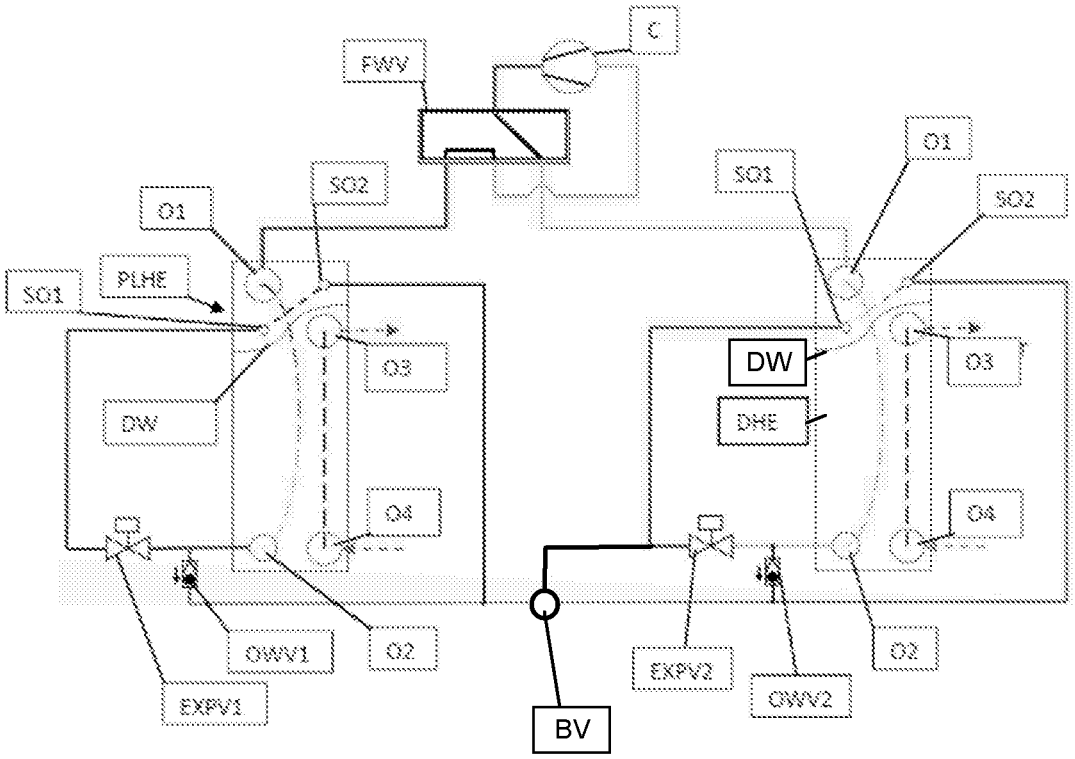
FIG. 11*a* is a schematic plan view showing the refrigeration system according to the first embodiment in cooling mode.
Figure 11B:
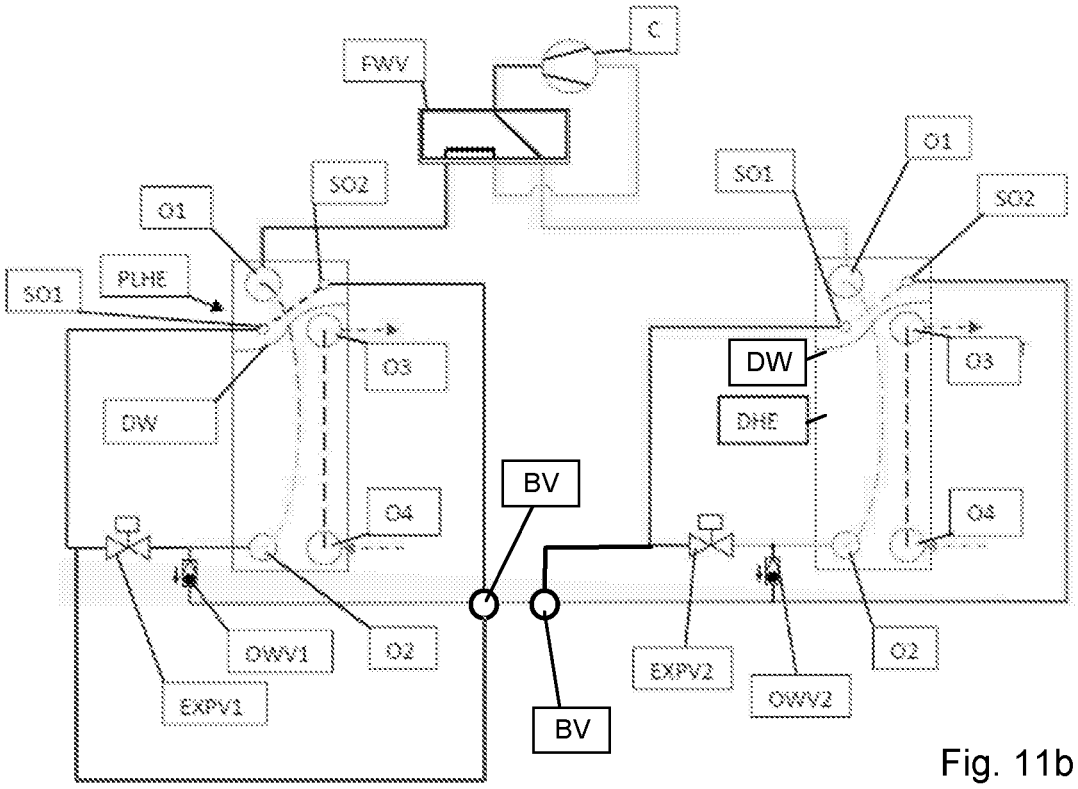
FIG. 11*b* is a schematic plan view showing the refrigeration system according to the second embodiment in cooling mode.

In FIGS. 111, 11*b*, the chiller system is shown in cooling mode. In order to switch mode from heating mode to cooling mode, the four-way valve FWV is controlled such that the compressor feeds compressed gaseous refrigerant to the opening O1 of the dump heat exchanger DHE. The second expansion valve EXPV2 will be entirely closed, the second one-way valve OWV2 will be open, the first one-way valve OWV1 will be closed and the first expansion valve EXPV1 will be open to control the pressure before and after the refrigerant has passed the first expansion valve EXPV1.

Hence, in cooling mode, the dump heat exchanger will function as a counter-current condenser, and the "suction gas heat exchanger" thereof will not perform any heat exchange, whereas the payload heat exchanger PLHE will function as a co-current evaporator. However, due to the provision of the suction gas heat exchange between the hot liquid refrigerant and semi-vaporised refrigerant about to leave the payload heat exchanger PLHE, the efficiency of the co-current heat exchange can be maintained at acceptable levels.

It should be noted that the suction gas heat exchanging parts are integrated with the dump heat exchanger DHE and the payload heat exchanger PLHE in FIGS. 10 and 11. In other embodiments, however, the suction gas heat exchangers may be separated from the dump heat exchanger and/or the payload heat exchanger.

In different climate zones, there are different needs for cooling and heating. In a warmer climate there is a larger need for cooling, wherein the refrigeration system will be used closer to the full cooling effect and a corresponding capacity in the suction gas heat exchanger is required to evaporate any droplets that otherwise would exit the evaporator. For example, the evaporator is the pay-load heat exchanger PLHE in cooling mode of the refrigeration system as described above, wherein the integrated suction gas heat exchanger thereof is used accordingly by means of the balance valve BV, which may be the same or another balance valve as illustrated schematically in FIG. 11*b*. When the refrigeration system is used at reduced effect, such as at 25% or 50% of the full effect, the suction gas heat exchanger is controlled through the balance valve BV. The refrigeration system is reversible and can be switched between cooling mode and heating mode by the four-way valve FWV as described above. As illustrated in the drawings, both the pay-load heat exchanger and the dump heat exchanger comprises an integrated suction gas heat exchanger which can be activated and controlled by the balance valve BV to ensure evaporation of the refrigerant before exiting the evaporator in both cooling mode and heating mode and with zero superheat in accordance with the effect at which the system is running. Hence, the amount of refrigerant conducted to the suction gas heat exchanger can be adapted to the system conditions in both heating mode and cooling mode to provide an efficient reversible refrigeration system for different types of climates.

Figure 12:
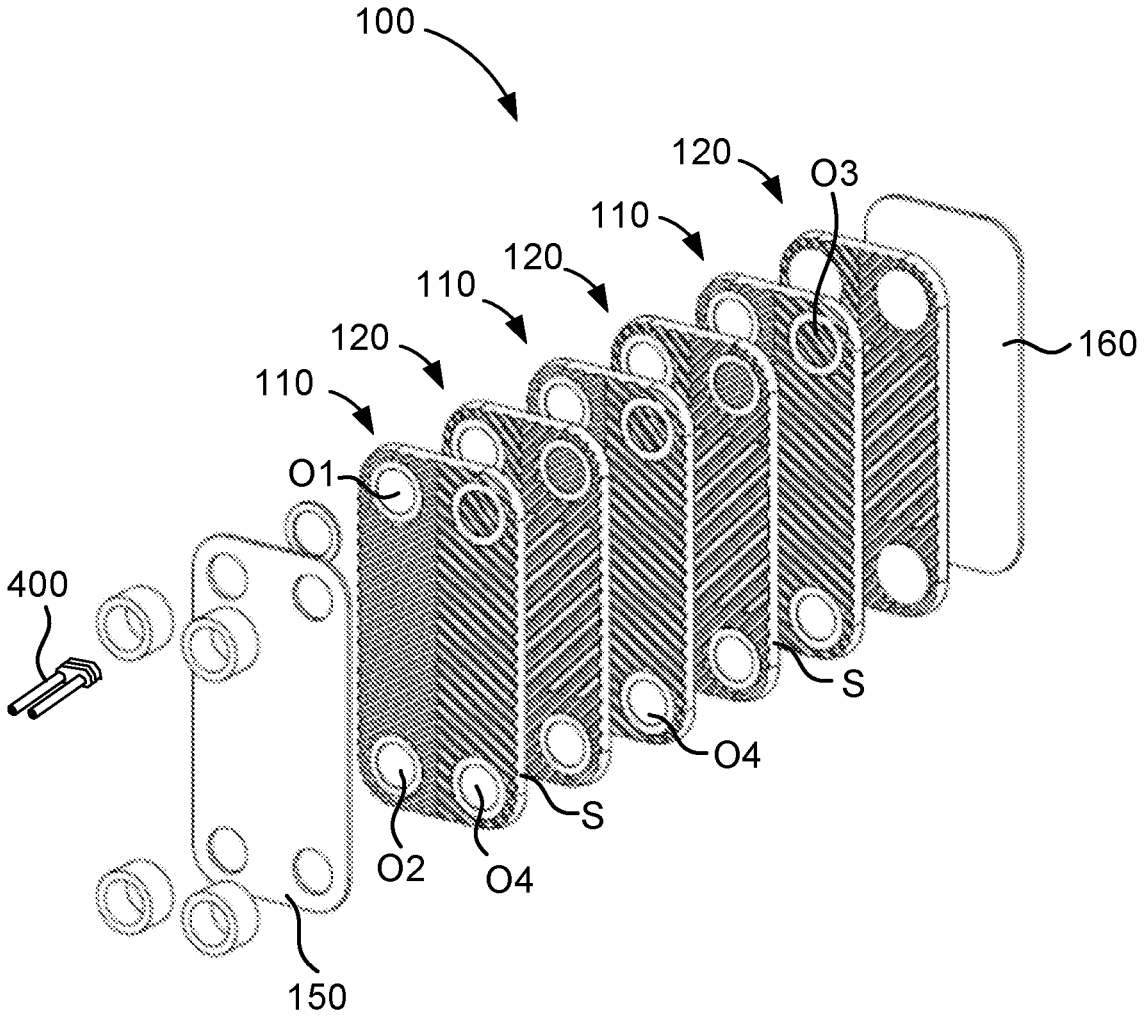
FIG. 12 is an exploded perspective view of a heat exchanger to be fitted with a retrofit port heat exchanger according to one embodiment of the present invention.

In another embodiment of the invention, a heat exchanger 100, such as for example shown in FIG. 12 and which may be a "standard" heat exchanger, may be provided with a retrofit port heat exchanger 400 (see FIGS. 13 and 14) comprising some kind of structure that fits in or just outside a port opening O1-O4 of the heat exchanger. The heat exchanger 100 of FIG. 12 comprises the first and second heat exchanger plates 110, 120 with the first and second pressed patterns of ridges and grooves R1, G1, R2*a*, R2*b*, G2*a*, G2*b* as described above but does not have the first and second small openings SO1, SO2 forming an integrated suction gas heat exchanger. The retrofit port heat exchanger 400 is, e.g. inserted into the first port opening O1 to form a suction gas heat exchanger, which is configured to be retrofitted onto and/or into an existing heat exchanger. Hence, the retrofit port heat exchanger 400 is configured to be mounted to an existing heat exchanger 100 to provide suction gas heat exchange generally as described with reference to FIGS. 10 and 11.

In the shown embodiment, the retrofit port heat exchanger 400 comprises a pipe 410 that suits within the port opening O1, said pipe being bent in a semi helix for allowing high temperature liquid refrigerant flowing therein in the same way as the refrigerant—flowing between the small port openings SO1 and SO2 of the previously described embodiments—exchanges heat with cold, gaseous (or semi gaseous) refrigerant about to leave the dump heat exchanger DHE or the payload heat exchanger PLHE. For example, the pipe 410 is arranged in a structure which resembles a part of a spiral.

Figure 13:
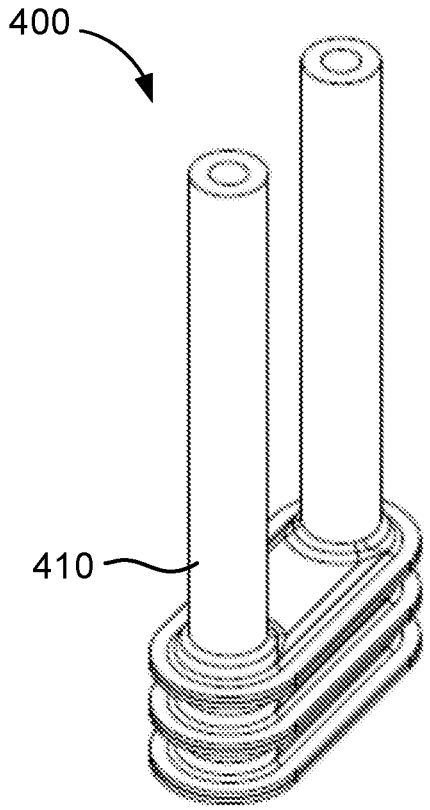
FIG. 13 is a schematic perspective view of a retrofit port heat exchanger according to one embodiment.
Figure 14:
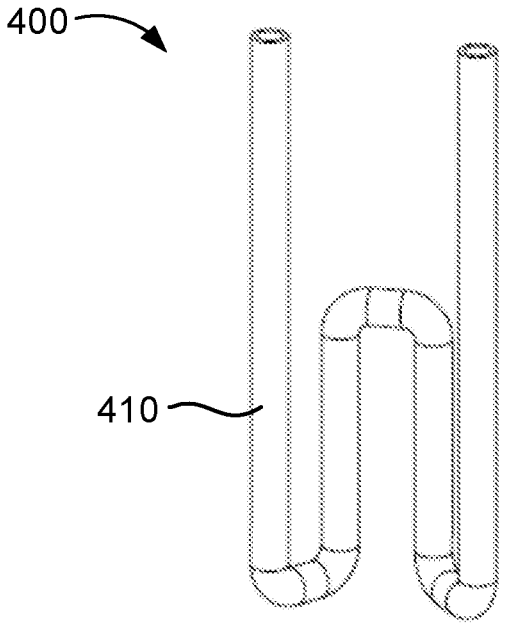
FIG. 14 is a schematic perspective view of a retrofit port heat exchanger according to one alternative embodiment.

In FIG. 13, an embodiment of the retrofit port heat exchanger 400 is shown. The pipe 410, which is configured to reside in the port opening O1 of the heat exchanger 100, comprises an inlet pipe portion and an outlet pipe portion connected to each other through a plurality of spaced apart heat exchange compartments for the refrigerant to flow through. For example, the inlet pipe portion and the outlet pipe portion are arranged in parallel, so that the refrigerant can flow in and out of the pipe portion 410 in opposite directions. The heat exchange compartments extend, e.g. substantially perpendicular between the inlet pipe portion and the outlet pipe portion. In FIG. 14, another embodiment of the retrofit port heat exchanger 400 is shown, wherein the pipe 410 of the retrofit port heat exchanger 400 is bent to exhibit a plurality of u-shapes. In the embodiment of FIG. 14, the pipe 410 comprises the inlet pipe portion and the outlet pipe portion arranged in parallel, so that the refrigerant can flow in and out of the pipe portion 410 in opposite directions. The inlet pipe portion is connected to a first u-shaped bend and continues to a second u-shaped bend and further on to a third u-shaped bend, which in turn is connected to the outlet pipe portion.

Figure 15:
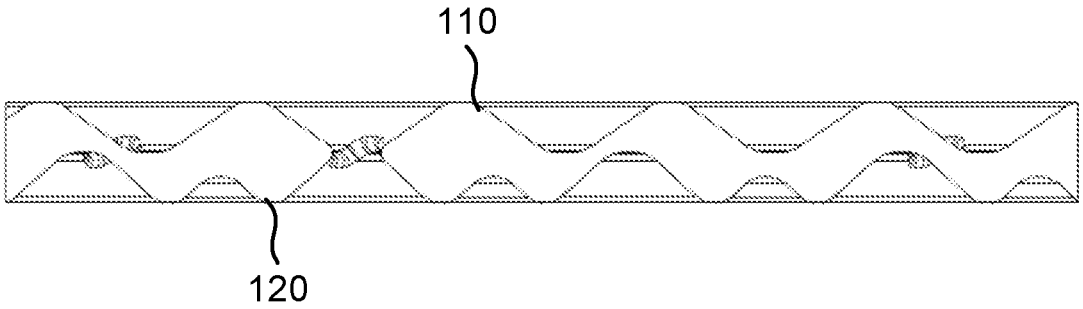
FIG. 15 is a schematic cross section view of a part of a heat exchanger comprising first and second heat exchanger plates according to another embodiment.

With reference to FIG. 15, a cross section of a part of a heat exchanger comprising first and second heat exchanger plates 110, 120 according to another embodiment is illustrated schematically. In the embodiment of FIG. 15, the first heat exchanger plate 110 is a symmetric heat exchanger plate, wherein the second heat exchanger plate 120 is an asymmetric heat exchanger plate as described above. Hence, the corrugation depth of the first heat exchanger plate 110 is constant, wherein the corrugation depth of the second heat exchanger plate 120 is varying. The second heat exchanger plate 120 is formed with at least two different corrugation depths. Also, the first and second heat exchanger plates 110, 120 are formed with corrugated patterns with different angles, such as chevron angles, as described above. In the embodiment of FIG. 15, the chevron angle of the first heat exchanger plate 110 is 54 degrees, wherein the chevron angle of the second heat exchanger plate 120 is 61 degrees. For example, neighbouring interplate volumes are different, so that the interplate volume on one side of the first heat exchanger plates 110 is different from the interplate volume on the opposite side of the first heat exchanger plates 110. Of course, this also applies to the second heat exchanger plates 120. Hence, the interplate volume between the first and second heat exchanger plates 110, 120 is different from the interplate volume between the neighbouring second and first heat exchanger plates. Similarly, a cross section area on one side of the first heat exchanger plates 110 is different from the cross section area on the opposite side of the first heat exchanger plates 110.

Figure 16:
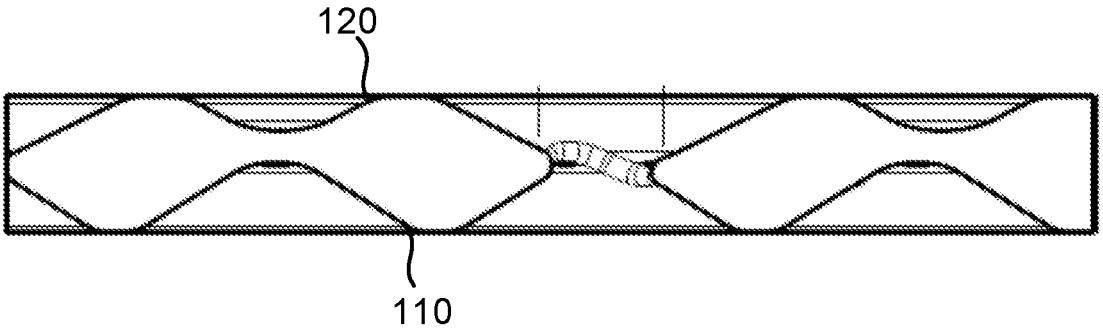
FIG. 16 is a schematic cross section view of a part of a heat exchanger comprising first and second heat exchanger plates according to another embodiment.

With reference to FIG. 16, a cross section of a part of a heat exchanger comprising first and second heat exchanger plates 110, 120 according to yet another embodiment is illustrated schematically. In the embodiment of FIG. 16 the first heat exchanger plate 110 is a symmetric heat exchanger plate, wherein the second heat exchanger plate 120 is an asymmetric heat exchanger plate as described above. In the embodiment of FIG. 16 the chevron angle of the first heat exchanger plate 110 is 45 degrees, wherein the chevron angle of the second heat exchanger plate 120 is 61 degrees.

Figure 17:
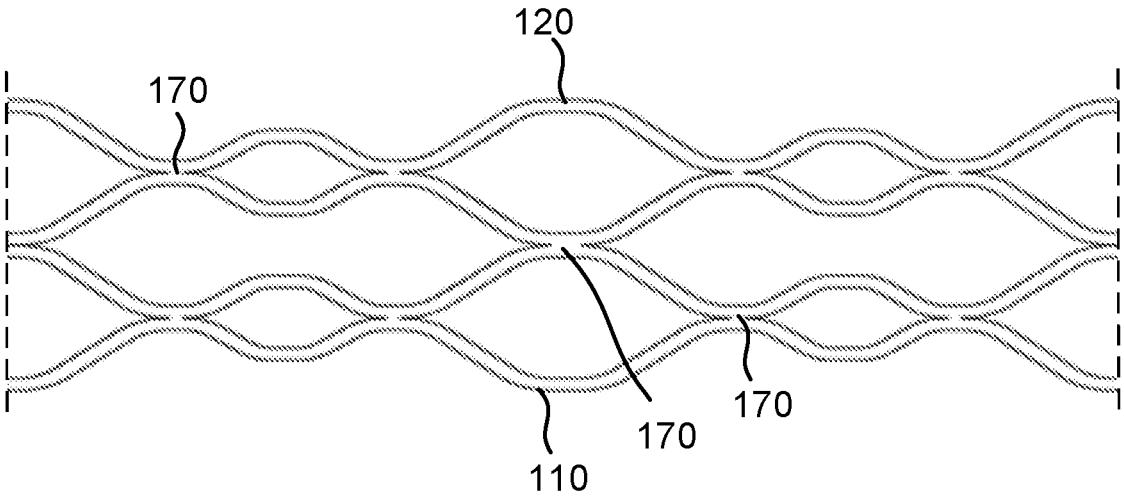
FIG. 17 is a schematic cross section view of a part of a heat exchanger comprising first and second heat exchanger plates according to yet another embodiment.

With reference to FIG. 17, a cross section of a part of a heat exchanger comprising first and second heat exchanger plates 110, 120 according to yet another embodiment is illustrated schematically. In the embodiment of FIG. 17 the first heat exchanger plate 110 is an asymmetric heat exchanger plate, wherein the second heat exchanger plate 120 is also an asymmetric heat exchanger plate. In the embodiment of FIG. 17 the chevron angle of the first heat exchanger plate 110 is different from the chevron angle of the second heat exchanger plate 120 as described above. Also, the interplate flow channels have different volumes as described above. For example, the brazing joints 170 are elongated, such as oval, and arranged in a first orientation in the interplate flow channels having a bigger volume and in a different, second orientation in the interplate flow channels having a smaller volume. As mentioned previously, this has implications on the pressure drop and fluid flow distribution throughout the heat exchanger, and thereby also affects the heat exchanging properties of a system comprising such a heat exchanger.

Figure 18:
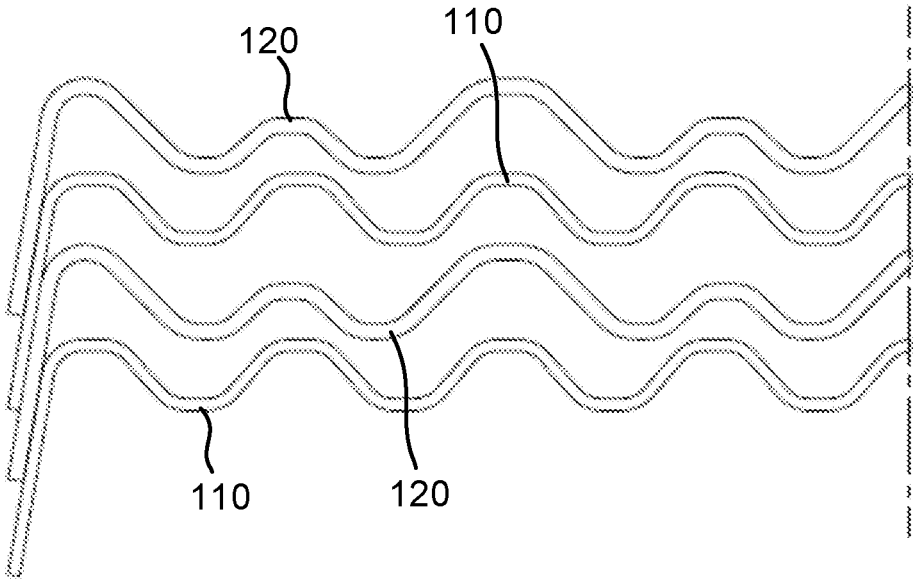
FIG. 18 is a schematic cross section view of a part of a stack of heat exchanger plates of first and second heat exchanger plates having different corrugation depths according to another embodiment.

With reference to FIG. 18, a cross section of a part of a stack of first and second heat exchanger plates 110, 120 according to yet another embodiment is illustrated schematically. In the embodiment of FIG. 18 the first and second heat exchanger plates 110, 120 are provided with different corrugation depths. The first heat exchanger plate 110 is a symmetric heat exchanger plate, wherein the second heat exchanger plate 120 is an asymmetric heat exchanger plate. Alternatively, both the first and second heat exchanger plates 110, 120 are symmetric or asymmetric. The chevron angle of the first heat exchanger plate 110 is different from the chevron angle of the second heat exchanger plate 120 and the interplate flow channel volumes formed by the first and second heat exchanger plates 110, 120 when brazed together in brazing joints 170 (not shown) are different.

The heat exchanger according to various embodiments of the present invention is, e.g. used for condensation or evaporation, wherein at least one media at some point is in gaseous phase. For example, the heat exchanger is used for heat exchange, wherein condensation or evaporation takes place in the interplate flow channels of bigger volume. For example, a liquid media, such as water or brine, is conducted through the interplate flow channels having smaller volume.

Figure 19:
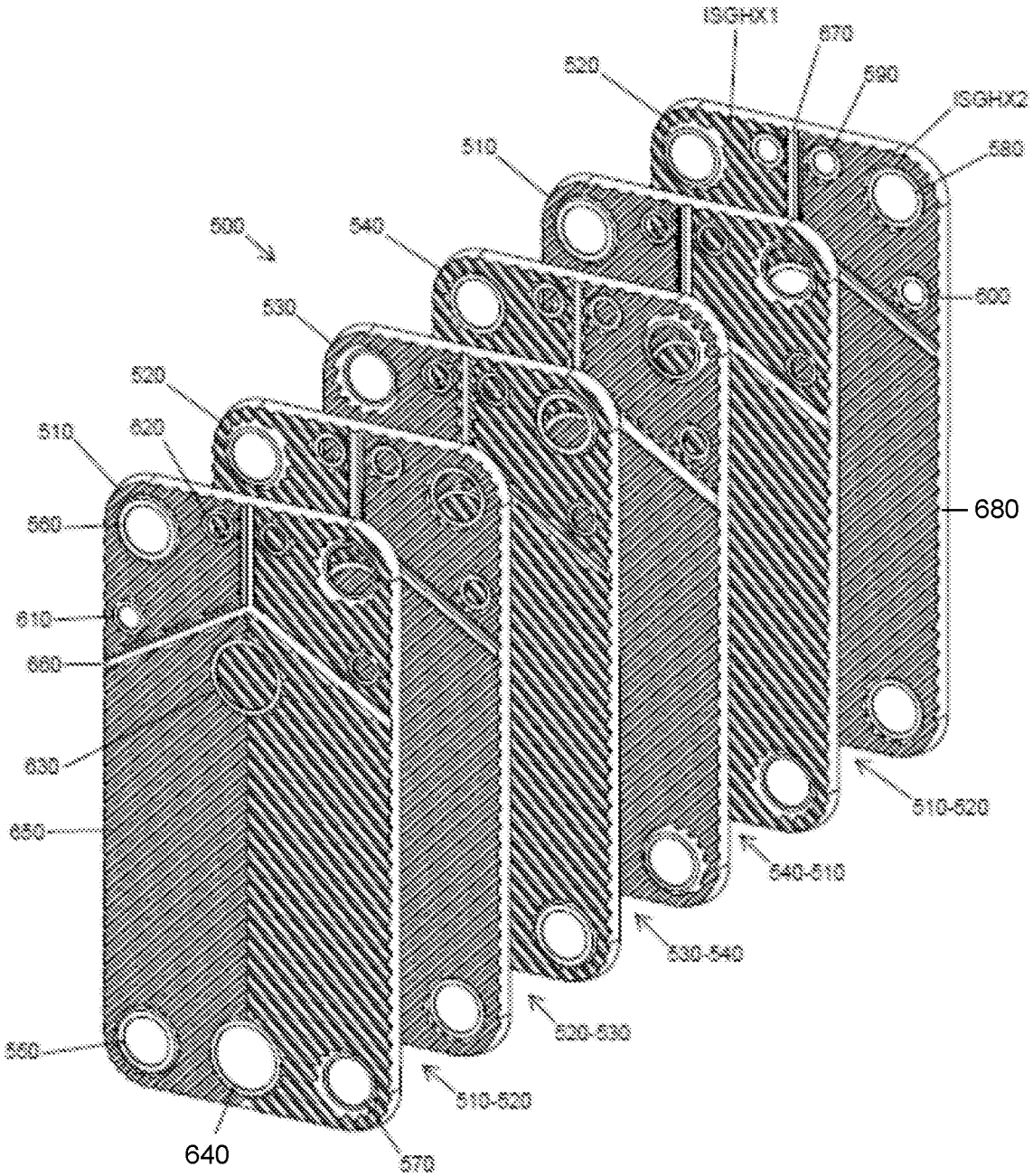
FIG. 19 is a schematic exploded perspective view of a true dual heat exchanger according to one embodiment of the present invention, said heat exchanger comprising dual integrated suction gas heat exchangers.

In FIG. 19, an exemplary brazed true-dual heat exchanger 500 comprising two separate integrated suction gas heat exchangers ISGHX1 and ISGHX2 is shown in an exploded view. True-dual heat exchangers are used for heat pumps or chillers where a large power ratio is required. Systems for true-dual heat exchangers are well known for people skilled in the art—they generally consist of two separate heat pump systems using a true-dual heat exchanger rather than two separate heat exchangers.

The true-dual heat exchanger 500 comprises six heat exchanger plates 510, 520, 530 and 540. Each of the heat exchanger plates is provided with a pressed pattern of ridges and grooves adapted to keep the plates at a distance from one another such that interplate flow channels 510-520, 520-530, 530-540, 540-510, 510-520 for media to exchange heat are formed between the heat exchanger plates. Also, each of the heat exchanger plates is provided with port openings 550, 560, 570, 580, 590, 600, 610 for refrigerant and two port openings 620, 630 for water or brine solution. The port openings are in selective fluid communication with the interplate flow channels in the following manner:

The port openings 630 and 640 are in fluid communication with the interplate flow channels 510-520 and 530-540, the port openings 550 and 560 are in fluid communication with the interplate flow channels 520-530, the port openings 570 and 580 are in fluid communication with the interplate flow channels 540-510, and the port openings 590, 600, 610 and 620 are in fluid communication with the interplate flow channels 510-520.

The heat exchanger plates 510, 520, 530 and 540 are divided into subsections wherein the flow interplate flow channels are connected and restricted in certain ways: in a main section 650, all interplate flow sections are used for media to exchange heat; in a first isghx (integrated suction gas heat exchanger) section ISGHX1, the interplate flow channels 520-530 are fluidly connected to the interplate flow channel 520-530 of the main section and either or both of the interplate flow channels 510-520 and/or 530-540 are connected to the port openings 610 and 620; and in a second isghx section ISGHX2, the interplate flow channels 540-510 are fluidly connected to the interplate flow channels 540-510 of the main section and either or both of the interplate flow channels 510, 520 and/or 530-540 are fluidly connected to the port openings 590, 600.

The main section is delimited from the isghx sections ISGHX1 and ISGHX2 by a dividing wall 660, which extends from one long side of each heat exchanger plate to the other long side. The dividing wall comprises plate surfaces arranged at different heights such that cooperation between such plate surfaces of neighbouring plates seals off the interplate flow channels 510-520 and 530-540 from communication with the corresponding interplate flow channels of the isghx sections ISGHX1 and ISGHX2. Moreover, the plate surfaces of the dividing wall 660 are configured such that cooperation between the plate surfaces of neighbouring plates seal off communication between the interplate flow channel 520-530 of the main section and the corresponding interplate flow channel of the second isghx section ISGHX2 and seals off communication between the interplate flow channel 540-510 of the main section and the corresponding interplate flow channels of the first isghx section ISGHX1.

A second dividing wall 670 is provided between the isghx sections ISGHX1 and ISGHX2 and extends from a short side of the heat exchanger plates and the dividing wall 660. Plate surfaces of this dividing wall are arranged such that plate surfaces of neighbouring plates contact one another for sealing off all interplate flow channels of the isghx sections ISGHX1 and ISGHX2 from communication with one another.

Finally, each of the heat exchanger plates are provided with a skirt 680 that extends around the entire periphery of the heat exchanger plates 510, 520, 530, 540, the skirts 680 of neighbouring plates being adapted to contact one another in order to create a circumferential seal stopping media from escaping the interplate flow channels. Moreover, the heat exchanger 500 according to the invention is preferably provided with a start and/or end plate (not shown), which are/is arranged on either sides of the stack of heat exchanger plates. Either of the start or end plate is provided with port openings, while the other is not, in order to create for a seal on the side of the port opening that is not provided with a connection for letting fluid to exchange heat in or out from the heat exchanger.

By the above arrangement, a true-dual heat exchanger having separate interplate flow channels between port openings 620 and 630 over the interplate flow channels 510-520 and 530-540 of the main section 650, between port openings 550 and 560 over the interplate flow channel 520-530 of the main section and the first isghx section ISGHX1, between port openings 570 and 580 over the interplate flow channel 540-510 of the main section 650 and the second isghx section ISGHX2, between port openings 610 and 620 over the interplate flow channel 520-530 of the first isghx section ISGHX1 and between port openings 590 and 600 over the interplate flow channel 540-510 of the second isghx section ISGHX2, respectively.

The selective fluid communication between the port openings and the interplate flow channels can be achieved in a number of ways, e.g. by providing surfaces around the port openings at different heights, such that the surfaces of neighbouring plates contact one another or do not contact one another. Alternatively, the selective fluid communication can be achieve by providing separate sealing rings in the port openings, said sealing rings being provided with openings for allowing communication where desired.

Also, it should be noted that although described as a brazed heat exchanger, it is possible to design a true-dual heat exchanger according to the invention as a gasketed heat exchanger.

The true-dual heat exchanger 500 according to the present invention is especially useful for heat pump or chiller applications wherein dual compressors are used in order to attain a large ratio between a low power and a high power.

Figure 20:
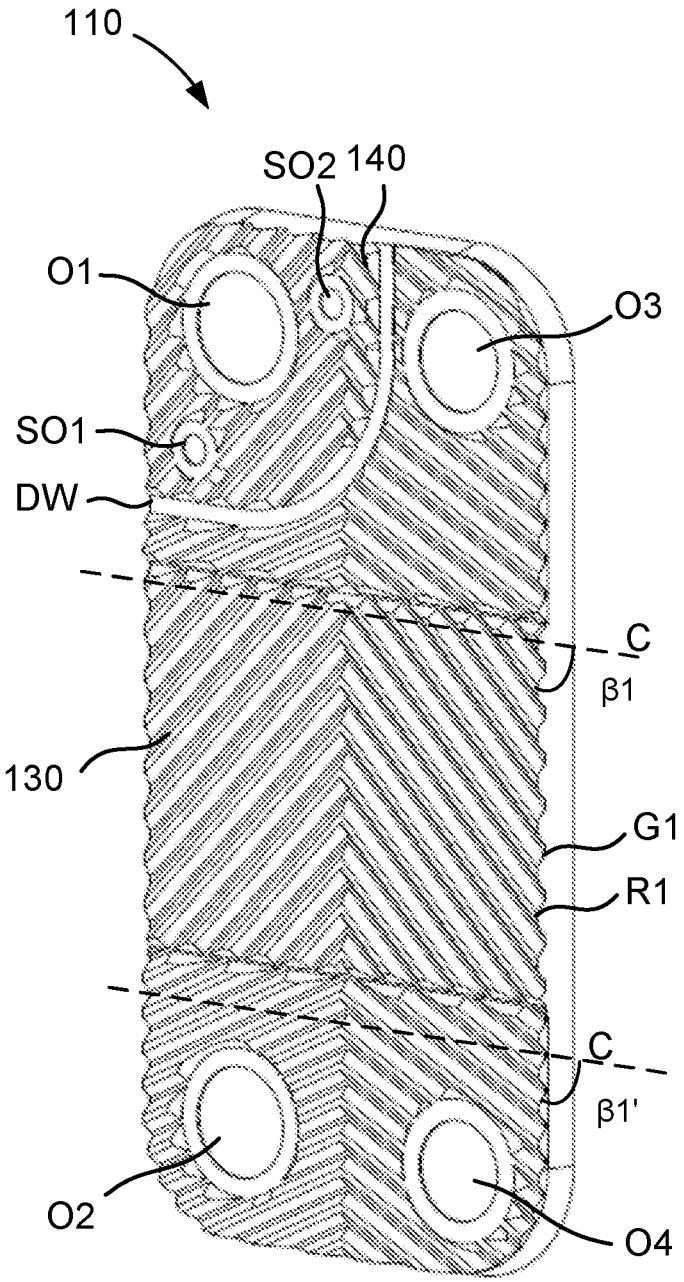
FIG. 20 is a schematic perspective view of another embodiment of the corrugated pattern of the heat exchanger plates, illustrating a corrugated pattern wherein the angle of the corrugated pattern in a central main heat exchanging section differs from the angle in sections at port openings of the heat exchanger plates.

With reference to FIG. 20 the first pattern of ridges R1 and grooves G1 of the first heat exchanger plate 110 is illustrated schematically. In FIG. 20 the first heat exchanger plate 110 comprises the small port openings SO1, SO2 and the dividing surface DW to provide the first heat exchanging portion 130 and the second heat exchanging portion 140 forming the integrated suction gas heat exchanger as described above. Alternatively, the first heat exchanger plate 110 comprises the dividing walls 660, 670 and the small port openings 590-620 to provide the two integrated suction gas heat exchangers ISGHX1, ISGHX2 as described with reference to FIG. 19. Alternatively, the heat exchanger plates are arranged without the integrated suction gas heat exchanger, wherein a heat exchanger of such heat exchanger plates can be provided with a retrofit suction gas heat exchanger as described above with reference to FIGS. 12-14 instead.

The pressed pattern according to the embodiment of FIG. 20 is a herringbone pattern but may alternatively be a pattern of oblique lines and thus exhibits the first angle β1 generally as described above with reference to FIGS. 6*a* and 6*b* but in a central main heat exchanging section of the heat exchanger plate 110. Hence, the first pressed pattern partially comprises the first angle β1. For example, the central main heat exchanging section extends across the first heat exchanger plate 110 from one side to the opposite side. The central main heat exchanging section is arranged between first and second heat exchanging sections at port openings of the heat exchanger plate, called end sections herein. The first and second end sections are, for example, arranged at opposite ends of the first heat exchanger plate 110. For example, the first and second end sections extend across the first heat exchanger plate 110 from one side to the opposite side thereof. The first end section includes port openings, such as the first port opening O1 and the third port opening O3. The second end section includes port openings, such as the second and fourth port openings O2, O4. The pressed pattern of ridges and grooves R1, G1 is arranged with an angle β1' in at least one end section, such as the first and second end sections, which angle β1' differs from the angle β1 of the pressed pattern in the central main heat exchanging section. For example, the direction of the pressed pattern is the same in the central main section as in the end sections. For example, the angle θ1' is the same in both end sections. Alternatively, the angle in the first end section is different from the angle in the second end section. In FIG. 20 the first heat exchanger plate 110 is illustrated as an example but it is understood that the second pressed pattern of the second heat exchanger plate 120 is designed in a corresponding manner, wherein the second pattern of ridges R2*a*, R2*b* and grooves G2*a*, G2*b* is arranged with the angle β2 in the central main heat exchanging section and the end sections are arranged with a different angle β2' (not illustrated).

The invention claimed is:

1. A brazed plate heat exchanger assembly comprising a plurality of first and second heat exchanger plates, wherein the first heat exchanger plates are formed with a first pattern of ridges and grooves, and the second heat exchanger plates are formed with a second pattern of ridges and grooves providing contact points between at least some crossing ridges and grooves of neighbouring plates under formation of interplate flow channels for fluids to exchange heat, said interplate flow channels being in selective fluid communication with port openings, the first pattern of ridges and grooves is different from the second pattern of ridges and grooves, so that an interplate flow channel volume on one side of the first heat exchanger plates is different from the interplate flow channel volume on the opposite side of the first heat exchanger plates, the second pattern of ridges and grooves has first and second grooves, wherein the first grooves are formed with a first depth and the second grooves are formed with a second depth different from the first depth, brazing joints are formed at said contact points between crossing ridges and grooves of the first and second heat exchanger plates, and said brazing joints are elongated, and a retrofit port heat exchanger, wherein the first and second heat exchanger plates are arranged alternatingly so that every other of the heat exchanger plates are the first heat exchanger plates, and the remaining heat exchanger plates are the second heat exchanger plates, wherein ridges and grooves of the first heat exchanger plates, at least in a central main heat exchanging section of the first heat exchanger plates, extend in a first angle, and ridges and grooves of the second heat exchanger plates, at least in a central main heat exchanging section of the second heat exchanger plates, extend in a second angle different from the first angle, wherein a difference between the first angle and the second angle is 2° to 35°, wherein the elongated brazing joints are arranged in a first orientation in the interplate flow channel volume on the one side of the first heat exchanger plates, and in a second orientation in the interplate flow channels on the opposite side of first heat exchanger plates, wherein the first orientation and the second orientation are different, and wherein the interplate flow channel volume on the one side of the first heat exchanger plates is larger than the interplate flow channel volume on the opposite side of the first heat exchanger plates.

2. The brazed plate heat exchanger assembly of claim 1, wherein the retrofit port heat exchanger comprises a pipe extending into a port opening of a plurality of heat exchanger plates.

3. The brazed plate heat exchanger assembly of claim 2, wherein the pipe of the retrofit port heat exchanger comprises a portion bent in the form of a semi helix, said portion extending into the port opening.

4. The brazed plate heat exchanger assembly of claim 1, wherein the first pattern is a first herringbone pattern or a first pattern of obliquely extending straight lines and the second pattern is a second herringbone pattern or a second pattern of obliquely extending straight lines, and wherein some of the ridges and grooves of the first and second patterns extend from one side of the heat exchanger plates to the other.

5. The brazed plate heat exchanger assembly of claim 1, wherein the interplate flow channels on the one side of the first heat exchanger plates have a different cross section area than on the opposite side.

6. The brazed plate heat exchanger assembly of claim 1, wherein at least the second heat exchanger plates are asymmetric.

7. The brazed plate heat exchanger assembly of claim 1, wherein the first heat exchanger plates are symmetric.

8. A refrigeration system comprising a compressor for compressing a gaseous refrigerant, such that the temperature, pressure and boiling point thereof increases;

a condenser, in which the gaseous refrigerant from the compressor exchanges heat with a high temperature heat carrier, said heat exchange resulting in the refrigerant condensing;

an expansion valve reducing the pressure of liquid refrigerant from the condenser, hence reducing the boiling point of the refrigerant;

an evaporator, in which the low boiling point refrigerant exchanges heat with a low temperature heat carrier, such that the refrigerant vaporizes; and a retrofit port heat exchanger exchanging heat between high temperature liquid refrigerant from the condenser and high temperature gaseous refrigerant from the evaporator, wherein the evaporator is formed by a brazed plate heat exchanger comprising a plurality of first and second heat exchanger plates, wherein the first heat exchanger plates are formed with a first pattern of ridges and grooves, and the second heat exchanger plates are formed with a second pattern of ridges and grooves providing contact points between at least some crossing ridges and grooves of neighbouring plates under formation of interplate flow channels for fluids to exchange heat, said interplate flow channels being in selective fluid communication with port openings, wherein the first pattern of ridges and grooves is different from the second pattern of ridges and grooves, so that an interplate flow channel volume on one side of the first heat exchanger plates is different from an interplate flow channel volume on an opposite side of the first heat exchanger plates, the second pattern of ridges and grooves has first and second grooves, wherein the first grooves are formed with a first depth and the second grooves are formed with a second depth different from the first depth, brazing joints are formed at said contact points between crossing ridges and grooves of the first and second heat exchanger plates, and said brazing joints are elongated, wherein the first and second heat exchanger plates are arranged alternatingly so that every other of the heat exchanger plates are the first heat exchanger plates, and the remaining heat exchanger plates are the second heat exchanger plates, wherein ridges and grooves of the first heat exchanger plates, at least in a central main heat exchanging section of the first heat exchanger plates, extend in a first angle and ridges and grooves of the second heat exchanger plates, at least in a central main heat exchanging section of the second heat exchanger plates, extend in a second angle different from the first angle, wherein a difference between the first angle and the second angle is 2° to 35°, wherein the elongated brazing joints are arranged in a first orientation in the interplate flow channel volume on the one side of the first heat exchanger plates, and in a second orientation in the interplate flow channels on the opposite side of first heat exchanger plates, wherein the first orientation and the second orientation are different, and wherein the interplate flow channel volume on the one side of the first heat exchanger plates is larger than the interplate flow channel volume on the opposite side of the first heat exchanger plates.

9. The refrigeration system of claim 8, comprising means for controlling the amount of heat exchange in the retrofit port heat exchanger.

10. The refrigeration system of claim 9, wherein the means for controlling the amount of heat exchange in the retrofit port heat exchanger is a controllable balance valve, which controls the amount of refrigerant bypassing the retrofit port heat exchanger.

11. The refrigeration system of claim 10, wherein the balance valve bypasses liquid refrigerant from the condenser past the retrofit port heat exchanger.

12. The refrigeration system of claim 9, wherein the means for controlling the amount of heat exchange in the retrofit port heat exchanger comprises dual expansion valves, wherein a first of the expansion valves is connected between an inlet of the evaporator and the retrofit port heat exchanger and a second of the expansion valves is connected between the inlet of the evaporator and the condenser.

13. The refrigeration system of claim 8, comprising a four-way valve, so that the refrigeration system is reversible.

* * * * *